US009560433B2

(12) United States Patent
Parker et al.

(10) Patent No.: US 9,560,433 B2
(45) Date of Patent: Jan. 31, 2017

(54) MICROPHONE MOUNTING METHOD AND APPARATUS

(71) Applicant: M. Klemme Technology, Corp., Vista, CA (US)

(72) Inventors: Brenda Klemme Parker, Vista, CA (US); David J. Corey, Vista, CA (US); David J. Fisk, Vista, CA (US); Steve Ouk, Vista, CA (US)

(73) Assignee: M. Klemme Technology, Corp., Vista, CA (US)

( * ) Notice: Subject to any disclaimer, the term of this patent is extended or adjusted under 35 U.S.C. 154(b) by 414 days.

(21) Appl. No.: 13/828,850

(22) Filed: Mar. 14, 2013

(65) Prior Publication Data

US 2014/0270311 A1 Sep. 18, 2014

(51) Int. Cl.
*H04R 25/00* (2006.01)
*H04R 1/08* (2006.01)

(52) U.S. Cl.
CPC ..... *H04R 1/08* (2013.01); *H04R 1/086* (2013.01)

(58) Field of Classification Search
CPC ..... H04R 1/08; H04R 1/086; H04R 1/02
USPC ..... 381/122, 189, 361–363, 368; 248/317
See application file for complete search history.

(56) References Cited

U.S. PATENT DOCUMENTS

| | | | | |
|---|---|---|---|---|
| 4,194,096 | A | 3/1980 | Ramsey | |
| 4,546,950 | A | 10/1985 | Cech | |
| 6,459,802 | B1 | 10/2002 | Young | |
| 7,637,684 | B2 | 12/2009 | Tims et al. | |
| 8,121,333 | B2 | 2/2012 | Woolf et al. | |
| 2006/0013427 | A1* | 1/2006 | Workman | H04R 1/08 381/363 |
| 2007/0195983 | A1 | 8/2007 | Klemme | |
| 2009/0008213 | A1 | 1/2009 | Tims et al. | |
| 2009/0016558 | A1 | 1/2009 | Woolf et al. | |
| 2011/0168867 | A1 | 7/2011 | Hennessey | |

FOREIGN PATENT DOCUMENTS

| | | | |
|---|---|---|---|
| CA | 2640112 | A1 | 8/2007 |
| CN | 101375627 | A | 2/2009 |
| DK | 1985153 | T | 12/2011 |
| EP | 1985153 | B1 | 1/2008 |
| GB | 2493378 | A | 6/2013 |
| WO | 2007085805 | A1 | 8/2007 |

* cited by examiner

*Primary Examiner* — Davetta W Goins
*Assistant Examiner* — Phylesha Dabney
(74) *Attorney, Agent, or Firm* — Stetina Brunda Garred & Brucker; Lowell Anderson

(57) ABSTRACT

A microphone support and enclosing windscreen has microphone supports curving about 270 degrees about an axis with upper and lower fingers to grip the microphone above and below the longitudinal axis of the microphone. The microphone supports move along an upper rail of a connector. First and second cage portions have longitudinal ribs connected to circular rings forming a windscreen support, with base rings on each cage portion connected to a bracket to encircle the microphone and its supports during use. One of the cage portions moves along the connector and rotates to allow access to the microphone.

42 Claims, 14 Drawing Sheets

MICROPHONE MOUNTING METHOD AND APPARATUS

STATEMENT RE: FEDERALLY SPONSORED RESEARCH/DEVELOPMENT

Not Applicable

BACKGROUND

Various structures have been provided to support microphones in ways that reduce the sensitivity of the microphone to vibrations and motion. But these prior art devices make it difficult to fasten the microphones to the support and inadequately reduce vibration which can distort microphone signals and cause other undesirable audio distortions and noises. There is thus a need for an improved microphone mount that allows easy and fast insertion and removal of the microphone and that deadens or reduces the sound transmission through the microphone support resulting from movement of the microphone or any windscreen enclosing the microphone.

Microphones come in different sizes and lengths. Unfortunately, may existing microphone supports have fixed dimensions so that a microphone is supported at one location and thus rotates or swings with movement of the support, causing distortion of the audio signal from the microphone and inadequate support of the microphone. Supports that grip the microphone body at more than one location are difficult to use, take time to insert the microphone into the supports and are often bulky—resulting in large windscreens to enclose the microphone and supports. There is thus a need for a microphone support and enclosure that more readily accommodates different microphones and that provides a stable support for microphones of various size and length.

Microphones used in sound recording studios are often so sensitive such that air from ventilation vents, wind and even mild breezes can cause noises that are picked up by the microphones or that distort recorded audio signals. Enclosing the microphones in casings reduces wind noise and distortion, but reduces microphone sensitivity. Further, the microphones are often used on long booms and the enclosures are heavy and difficult to maneuver or to fasten in position during sound recordings. There is thus a need for a lightweight windscreen that reduces wind noise and is easy to position and fasten in place.

Microphone windscreens are often glued together or held together by elastic bands. Over time the glued joints loosen and the rubber bands deteriorate so the windscreens become loose and creak when moved slightly as by wind blowing against the windscreens. The resulting noises are picked up by microphones enclosed in the windscreen or held in the supports, and that degrades the sound performance of the microphone. There is thus a need for a windscreen and support that reduces or avoids these problems.

Microphones may be placed in protective structures to protect the microphone and to shield the microphone from wind-generated noise. But such protective structures are often heavy and costly, and may even block or distort the acoustic signals the microphone is to detect. There is thus a need for an improved microphone enclosure that is lightweight yet strong and that is easy to manufacture.

Microphone supports and windscreens are often subjected to harsh use, varying from being dropped, hit with things, hit by animals, or having some or all of the windscreen crushed by various objects, animals or accidents. It is expensive to replace a windscreen or support each time it is damaged.

There is thus a need for an improved microphone support and windscreen that allows fast repair and/or partial replacement of portions of the support or windscreen.

In addition to the above deficiencies, existing microphone enclosures are cumbersome to apply to the microphones and make it difficult to switch or adjust microphones placed within such disclosures. It is difficult to fit microphones into the supports and to then place the supports inside a windscreen. Thus, changing microphones becomes difficult and time consuming. There is thus a need for a microphone enclosure that allows easy access to microphones placed within the enclosures.

BRIEF SUMMARY

A microphone enclosure and support is provided using two spaced apart microphone supports that each extend from a base and curve about 270 degrees around a longitudinal axis of the microphone, or spiral around an even larger curvature. The microphone support ends in upper and lower fingers that grip the microphone above and below the longitudinal axis. The microphone supports are separately positionable along an upper (radially inward) rail of a connector. The microphone supports and microphone are enclosed in first and second cage portions that each has a plurality of longitudinal ribs connected to circular rings forming a protective structure, with a cover over the cage portions to shield the microphone from wind noise and to enclose a dead-air space around the microphone. Base rings on each cage portion are releasably connected to a central connecting bracket that in turn is connected to the elongated connector to fully enclose the microphone and its supports during use. One of the cage portions moves along the connector and rotates away from the longitudinal axis in order to allow fast and easy access to the microphone. Rotation of one cage portion away from the microphone allows access to the microphone from 360 degrees. If the microphone head is in the exposed portion, ready access is achieved to allow maintenance, removal, repositioning or repair of the microphone.

The spiral configuration of the microphone supports allows a resilient support. Making the supports out of glass-filled polymer helps reduce the transmission of vibration to the microphone, especially low frequency noise. The use of spaced-apart microphone supports provides a very stable microphone support. The use of positionable bases on each microphone support allows adjustment of the spacing between supports and allows the location of the supports along the length of the microphone body to be varied as desired. The movable supports also allow positioning the microphone within the windscreen and allows supporting different microphone bodies, differently. As desired, the base and its attached microphone may be easily and quickly removed and replaced with a different base and support. Fingers forming a diamond-shape enclosure open at one end allow ready insertion and removal of microphone bodies, especially microphone bodies having two circular sides joined by two opposing flat surfaces.

The cage portions use a ring-stiffened rib structure and that provides a very light frame to enclose the microphone and microphone supports when a windscreen cover is placed over the structure. The ring-stiffened rib structure also provides a very strong structure that resists movement under wind loads and that reduces creaking and noise. Locating the rings to keep the ribs slightly bent provides a spring-loaded structure that keeps the ribs resiliently urged against the rings and provides a continually stressed enclosure that further helps reduce creaking and noise generation by the enclosure. Using a resilient material for the cover may further help compress the cage portions and further reduce movement and creaking of the microphone enclosure during use. The ring-stiffened, longitudinal rib construction allows the elimination of adhesives and rubber bands to hold the parts together, thereby increasing reliability and longevity while reducing assembly time and lowering costs.

The light weight makes it easier to position the microphone, support and enclosure and further reduces sway and movement and decreases settling time. The light weight allows a larger enclosure of dead air around the microphone, providing sound deadening insulation around the microphone during use. Making the cage portions out of glass-filed polymer further helps reduce vibration generation and transmission. The rib and ring construction also allows repair of portions of the windscreen support that may be damaged during use, rather than requiring replacement of an entire windscreen when only a portion is damaged.

The releasable connection of the cage portions allows one or both of the two cage portions that form the windscreen to be easily and quickly opened in order to allow access to the microphone. By sliding one cage portion away from the other quick, but limited access is allowed. By rotating on cage portion out of the way one entire end of the microphone and at least one support can be completely exposed for access. That allows rapid and easy access to and replacement or repair of microphones. As desired, both cage portions can be removed from the connecting bracket quickly, yet just as quickly reconnected to provide a sturdy, lightweight windscreen for the microphone.

There is thus provided a support for a microphone having a longitudinal axis in which the support includes an elongated connector having an inner rail portion and an outer connecting portion. The support further includes first and second microphone mounts, each microphone mount including a base configured to movably fasten to the elongated connector along a length of the elongated connector and a curved support arm. The curved support arm has a first end connected to the base and a second end connected to a holding mechanism configured to engage opposing portions of the microphone on opposing sides of the longitudinal axis during use. The curved support arm also has a circular shape extending over at least 180 degrees between the first and second ends of the arm. The curvature of a midline of the curved support arm is defined by a plurality of radii located inside the support arm.

In further variations, the support has a base with a rotating cam lock to releasably fasten the base to the elongated connector. The elongated connector is generally parallel to the longitudinal axis during use. The holding mechanism may advantageously include two opposing fingers, each finger having an inner and outer portion extending in opposing directions and having a free distal end, the ends of the fingers being spaced apart a predetermined distance, with the fingers resiliently urged against opposing portions of the microphone during use. Each curved support arm may be mounted in the same orientation (FIGS. 2, 9) or in an opposing orientation (FIG. 13) in which the curved support arms curve in opposing directions with the predetermined distance between the ends of the fingers opening in opposing directions.

The support arms are continuously curved (without any recurvature in an opposing direction) and may have two radii of curvature R between about 1 and 1.5 that extend over 180 degrees of a length of the midline of the curved support arm. The support arms continuously curve about the longitudinal axis of the microphone and approach the axis at the distal end of the arms which engage the microphone. The support arms preferably extend less than 270 degrees and preferably less than 360 degrees from the connection with the base from which the arms extend, the arms preferably extending in the shape of a spiral or portion thereof. Each support arm may have a cross-sectional configuration along at least half of its length selected from one of an I section, an H section, a T section, a C section and a closed box section.

In further variations, the microphone support may include a protective cage having first and second cage portions each configured to connect to a different one of the inner and outer portions of the elongated connector. A cover is placed over the cage portions to form a windscreen. At least one of the cage portions may be configured to be movably fastened to the elongated connector during use and each cage portion may be configured to encircle the longitudinal axis and a microphone located on that axis during use. Each cage portion preferably has a plurality of elongated ribs having a distal end connected to a first restraining ring and an opposing end connected to a second restraining ring, with each rib being further connected to a third restraining ring interposed between the first and second rings. The first ring is smaller in diameter than the second and third rings and the second restraining rings are releasably connected to a mounting bracket. The ribs preferably each have an inner edge and an opposing outer edge with the inner edge closer to the longitudinal axis during use, and with the first and second rings connect to one of the first or second edges and the third ring connected to the other of the first or second edges. Alternatively described, the ribs each have opposing inward facing and outward facing sides relative to the longitudinal axis during use and the first and second rings connect to the outward facing side of ribs and the third ring connects to the inward facing side of the ribs, with a locking ring engaging an inward facing side of the ribs and releasably engaging the first ring. Described yet another way, the cage portions have elongated connectors have an inner and outer portion and the first cage portion has the second ring connected to a mounting bracket that is connected to the outer portion of the elongated connector during use, the mounting bracket forming an opening through which part of the inner portion extend during use.

The second cage portion may have the second ring movably connected to the outer portion of the elongated connector during use with the second ring of the second cage portion being further releasably connected to the mounting bracket. The second cage portion advantageously has an elongated base having a slot therein releasably engaging the support in order to position the second cage portion relative to the inner portion of the elongated connector during use. The second cage portion preferably has a fastener with a shaft that extends through a slot in the elongated connector so the shaft and second cage portion can move along a length of the slot. The second cage portion is preferably rotatably connected to the outer portion of the elongated connector so as to rotate relative to the elongated connector about an axis orthogonal to the plane containing the elongated connector to provide access to an inside of the first cage portion. More specifically, the first and second cage portions are connected to the elongated connector so the cage portions have a first, second and third position. In the first position the cage portions encircle the longitudinal axis and enclose the microphone supports within the cage portions. In the second position the cage portions encircle the longitudinal axis and the second ring of each cage portion is spaced apart a predetermined distance by a gap. In the third position the second portion is rotated at an angle relative to the longitudinal axis and allows access to at least one support arm.

There is also advantageously provided an enclosure and support for a microphone extending along a longitudinal axis during use. The enclosure and support include a mounting connector having an inner rail and an outer portion outward of or below the rail with the rail being parallel to the longitudinal axis. At least one microphone support is configured to slide along and releasably engage the inner rail to position the support along a length of the rail. The at least one microphone support may also be configured to releasably engage the microphone during use to support the microphone along the longitudinal axis during use. The enclosure further includes a first cage portion having a plurality of first elongated ribs. Each first rib has a first distal end and a second opposing end with the first ribs configured to engage a plurality of rings including a first base retaining ring. The rings and ribs encircle the longitudinal axis and are spaced apart from the at least one microphone support during use. The enclosure includes a second cage portion having a plurality of second elongated ribs with each second rib having a first distal end and a second opposing end. The second ribs are configured to engage a plurality of rings including a second base retaining ring. The rings and ribs encircle the longitudinal axis and are spaced apart from the at least one microphone support during use. The support and enclosure includes a bracket engaging the mounting connector and further engaging the first and second base rings of each cage portion during use. Further, the first end of each rib preferably extends through an opening in a portion of the base ring to abut an inner side of the base retaining ring and the ribs snap lock to at least one of the rings. A cover is placed over each of the cage portions to form a windscreen that encloses the microphone and supports when the cage portions are engaged with the bracket.

In further variations, the enclosure and support have each cage portion including an outer ring engaging the first end of the ribs on an outer portion of a plurality of the ribs, with each cage portion further having and an intermediate ring located between the first and second ring of a cage portion and engaging an inner side of a plurality of the ribs. Moreover, each cage portion may further include a locking ring engaging the inner side of a plurality of ribs adjacent the location of the first ring. Further, the second cage portion advantageously has a first position engaging the bracket, a second portion spaced apart from the bracket but encircling the longitudinal axis, and a third position spaced apart from the bracket and rotated at an angle to the longitudinal axis to allow access to the at least one mounting support.

In still further variations, the at least one microphone support preferably includes a pair of curved support arms each extending from a base movably mounted to move along a length of the inner rail, with each support arm curving continuously about the longitudinal axis a distance less than 360 degrees and ending in the support configured to releasably engage the microphone during use. The curved arms may each end in a pair of fingers including a lower finger located below the longitudinal axis and an upper finger located above the longitudinal axis, with the support arms each extending over an arc of more than 180 degrees. Moreover, the microphone arms preferably extend from the base in opposing directions.

There is also advantageously provided an enclosure and support for a microphone that extends along a longitudinal axis during use that includes a mounting support with a microphone support configured to releasably engage a microphone to hold the microphone along the longitudinal axis during use. The enclosure includes first and second cage portions each having a plurality of elongated ribs connected to a plurality of rings to form a structure encircling the longitudinal axis during use. A cover is placed over the cage portions to form a windscreen. Each plurality of rings includes a base retaining ring releasably connected to a connecting bracket that engages the mounting support to position the connecting bracket relative to the mounting support. The second cage portion may releasably engage the mounting support at different locations to define first and third positions. The first position has the base retaining ring of the second cage portion engaging the connecting bracket so the second cage portion encircles the longitudinal axis. The third position has the second cage portion rotated at an angle relative to the longitudinal axis with the base retaining ring of the second cage portion located to one side of the longitudinal axis.

In further variations, the second cage position has a second position encircling the longitudinal axis with the base retaining ring of the second cage portion spaced apart from the connecting bracket. Further, the microphone support may be connected to a base that releasably engages and is positionable along a length of the mounting support, with the microphone support curving continuously around the longitudinal axis through an arc greater than 180 degrees and ending in two fingers located to engage the microphone on opposing sides of the longitudinal axis.

BRIEF DESCRIPTION OF THE DRAWINGS

These and other features and advantages of the invention will become more apparent in light of the following discussion and drawings, in which like numbers refer to like parts throughout, and in which.

DETAILED DESCRIPTION

Figure 1:
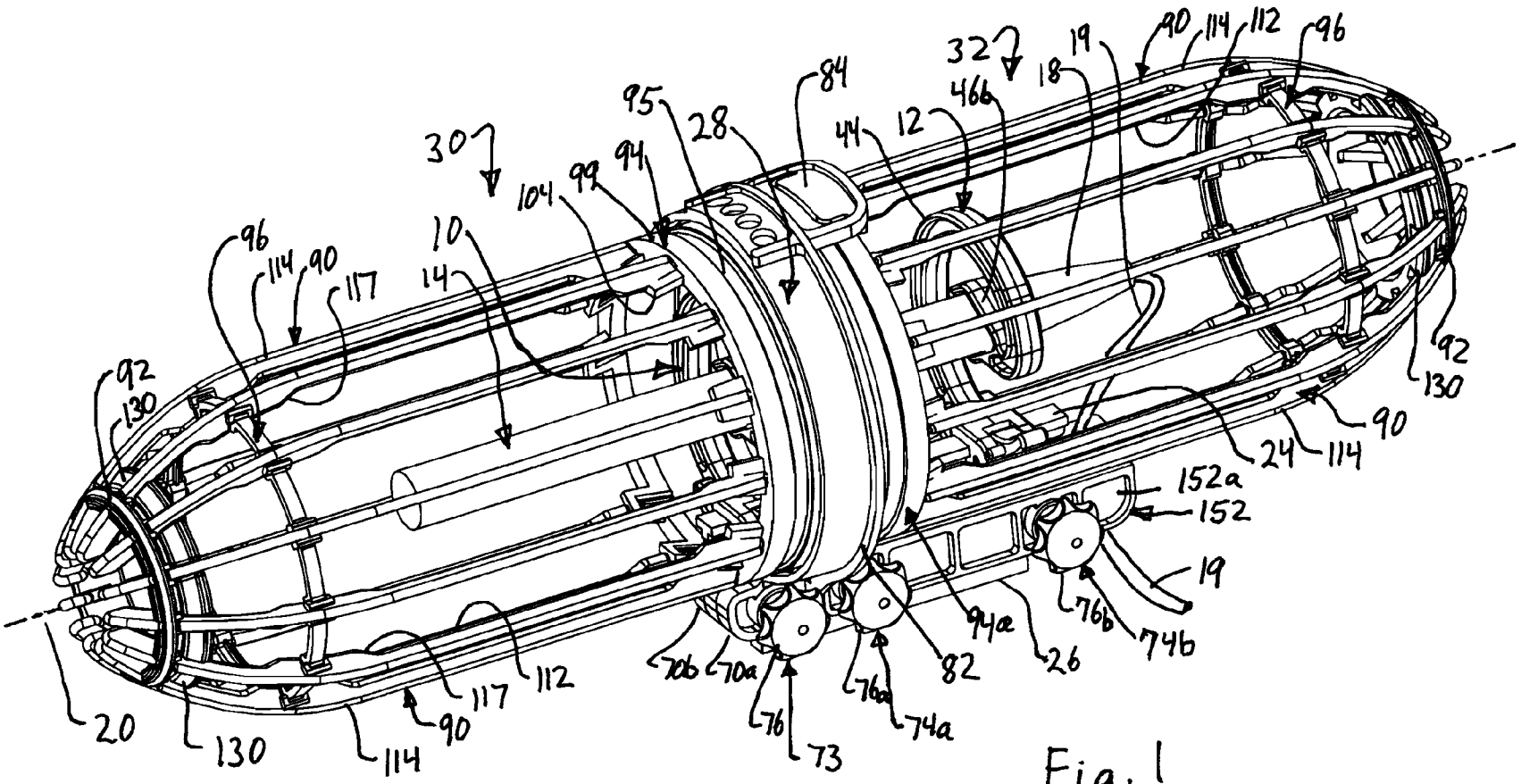
FIG. 1 is perspective view of a microphone enclosure and support without a cover, with first and second cage portions in a first, engaged position.
Figure 2:
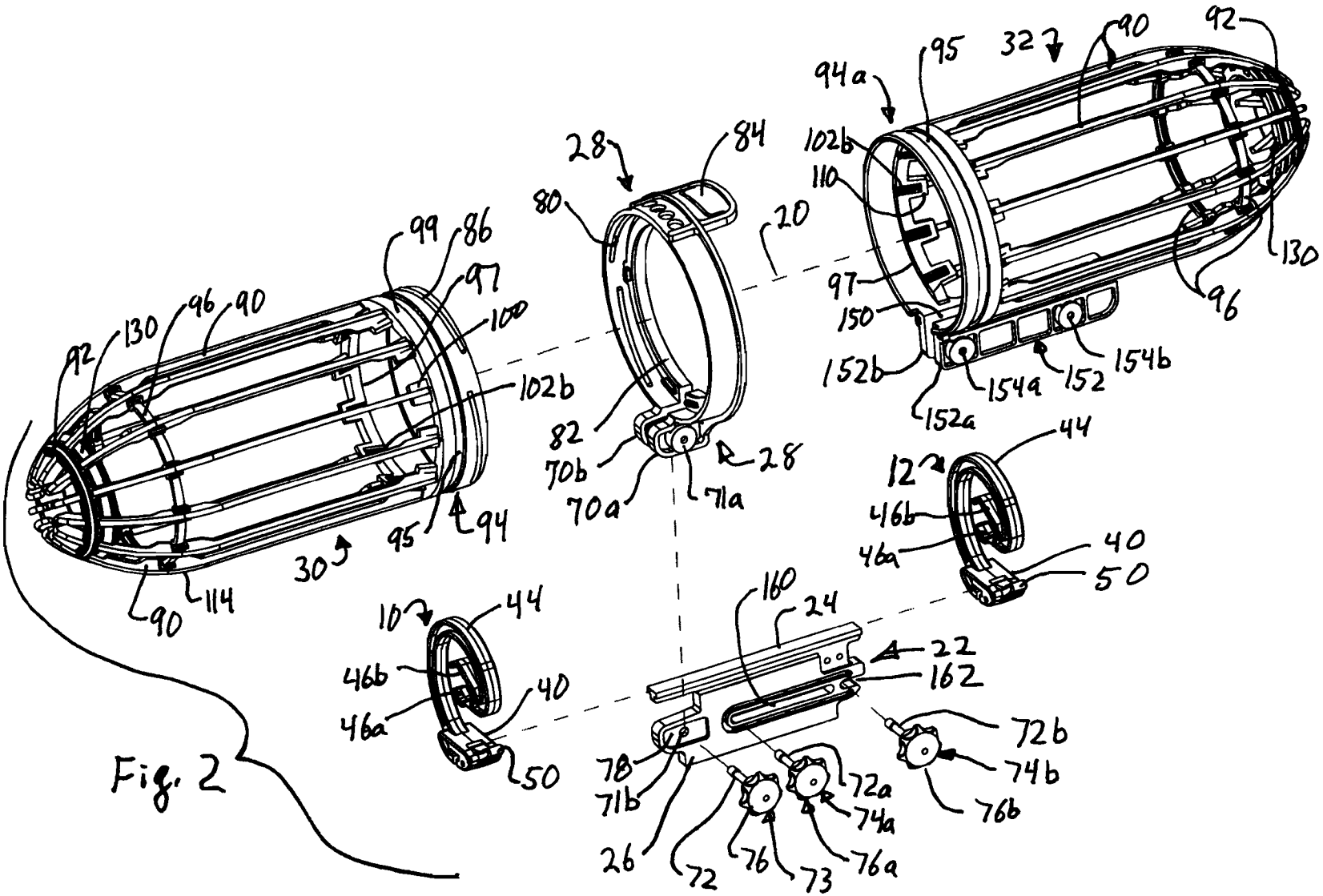
FIG. 2 is an exploded perspective view of the microphone enclosure and support of FIG. 1.
Figure 12:
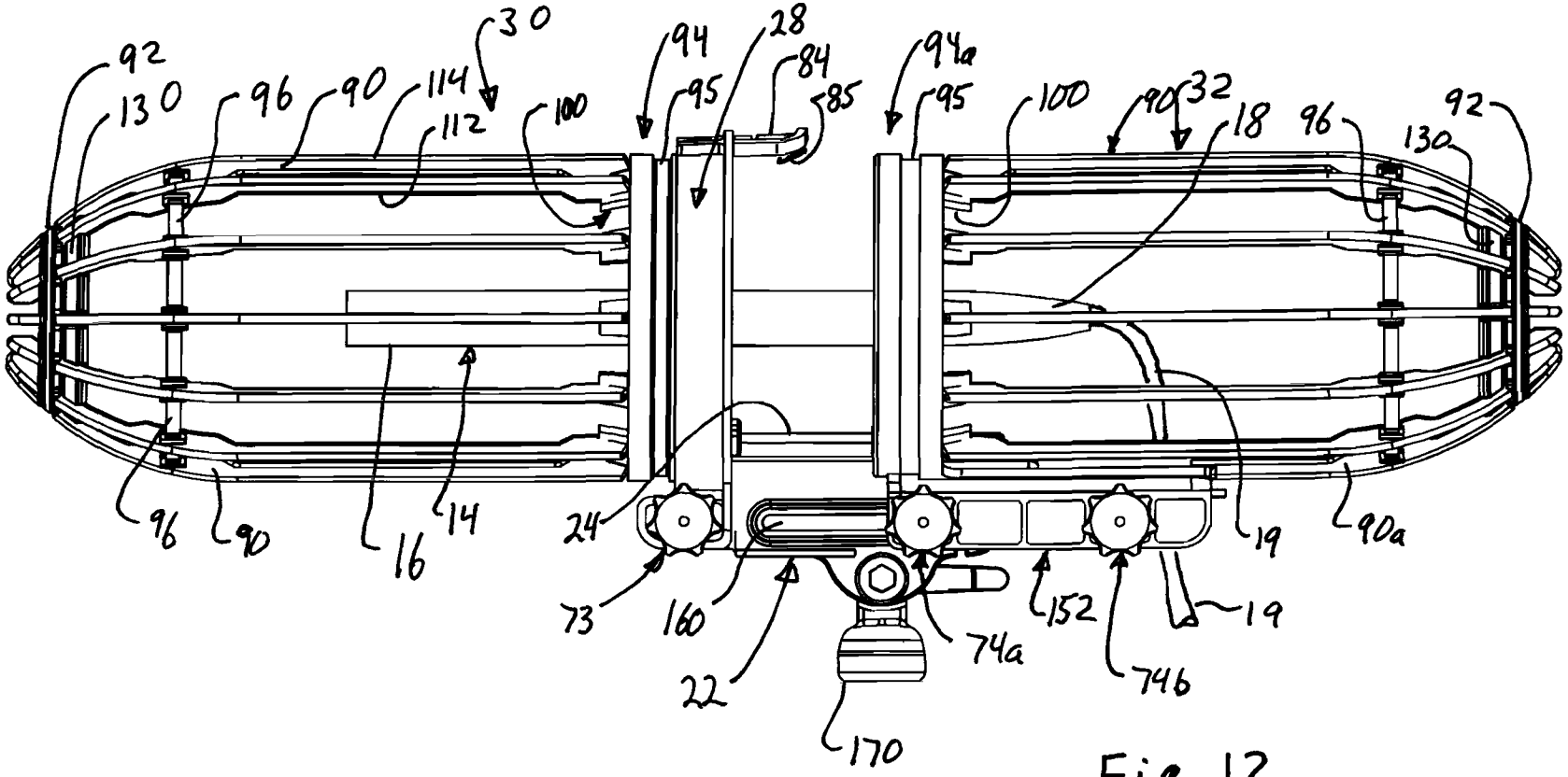
FIG. 12 is a plan view of the microphone enclosure and support of FIG. 1, in a second position.

FIGS. 1-2 show first and second microphone supports 10, 12 which are spaced apart a distance sufficient to hold an elongated body of microphone 14 with a sensor end 18 and opposing cable end 16 from which optional communication cables connect to the microphone to carry electronic communication signals. The microphone extends along longitudinal axis 20 during use and may be a wireless microphone or transmit electronic signals relating to audio input through and electrically or optically conductive cord or cable 19 (FIG. 12). The supports are movably connected to an elongated connector 22 having an inner rail portion 24 and have what is preferably a generally flat piece extending radially outward from axis 20 forming an outer connecting portion 26. The relative directions and distances "inner" and "outer" are with reference to the longitudinal axis 20 of the actual or fictional microphone held by the supports 10, 12 during use.

A connecting bracket 28 is fastened to the elongated connector 22, and is preferably removably fastened to the outer connecting portion. The connecting bracket is preferably a cylindrical, ring-shaped part as described in more detail herein. A first cage portion 30 is connected to a first side of the bracket 28 and a second cage portion 32 connected to the opposing, second side of the bracket. The first and second cage portions 30, 32 enclose the microphone 14 during use to protect the microphone from contact by humans, to protect the microphone from handling noise, and to protect the microphone from low frequency rubble. When the cage portions 30, 32 are covered with material 34 the cage portions form a windscreen that further protects the sensor 18 from wind noise, and that may also inhibit a person's hands from contacting the microphone 14 or its support 44. One or both of the cage portions 30, 32 may be moved or removed to allow access to the supports 10, 12 and microphone 14.

A cover 34 (FIG. 10) may be placed over the cage portions 30, 32 to reduce wind noise and form a windscreen. The cover 34 is typically a thin sheet of polyester material or a long nap or furry material having a nap length of 0.5-0.75 inches for more windy situations. The cover 34 is selected to transmit sounds with minimal distortion. If long nap material is used the increased nap length adds mass and reduces wind noise, but a long nap may also reduce higher frequencies more than other portions of the audio spectrum commonly detected and recorded for human listeners.

Figure 3:
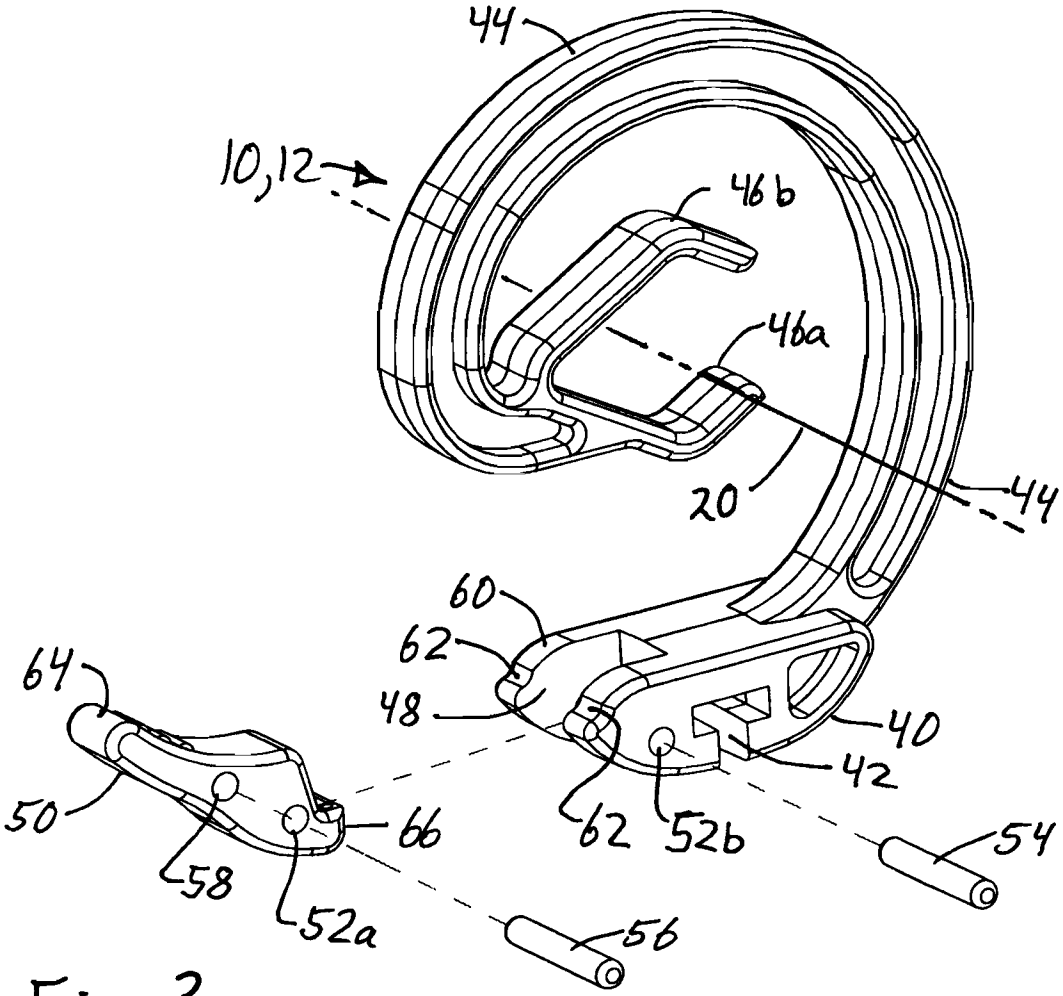
FIG. 3 is an exploded perspective view of a microphone mount of FIG. 2.
Figure 11:
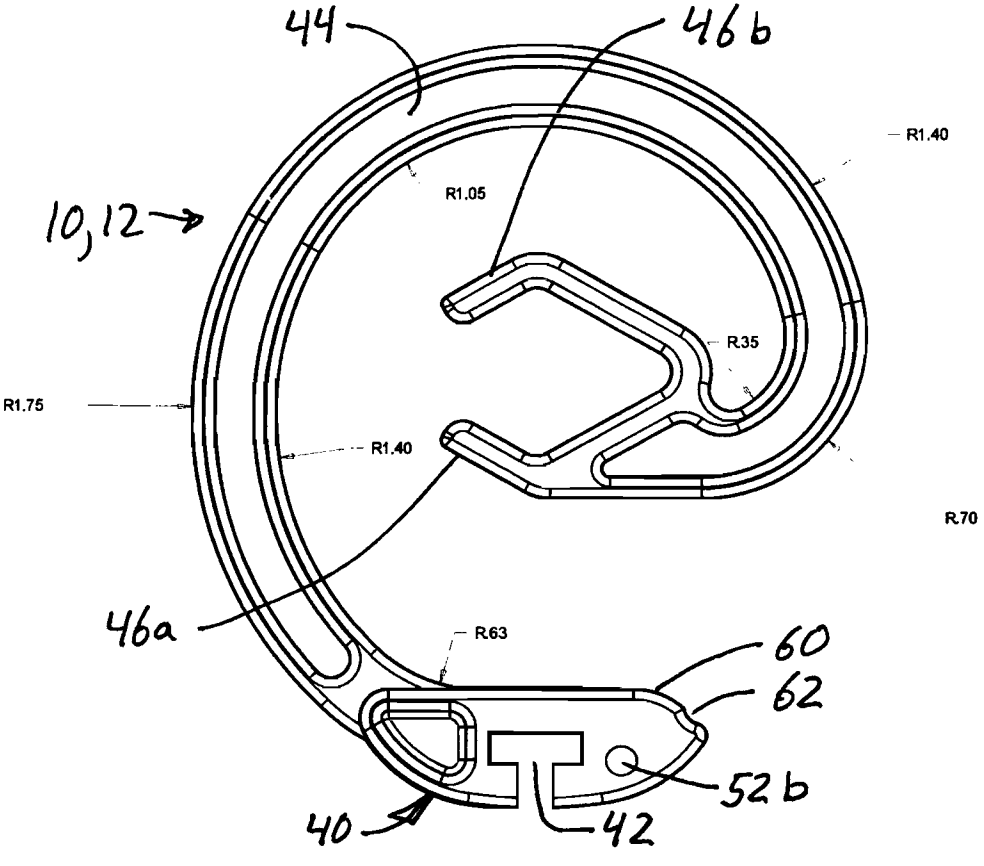
FIG. 11 is a plan view of a microphone support of FIG. 1.

In more detail, referring to FIGS. 2, 3 and 11, the microphone supports 10, 12 suspend the microphone resiliently to provide shock resistance and acoustic isolation for the microphone 14. The supports 10, 12 are preferably constructed the same so only support 10 will be described in detail. The support 10 has a microphone base 40 within which is configured to engage the inner rail portion 24 of elongated connector 22 so the microphone base 40 can be repositioned along a length of the rail portion 24. This engagement is achieved in the depicted embodiment by a shaped slot 42 configured to slide along the outside of upper (radially inward) rail portion 24 of elongated connector 22. The slot 42 has a T-shaped cross section but the shape can vary.

A curved arm 44 extends from the microphone base 40 to encircle a portion of the longitudinal axis 20 in a plane perpendicular to that axis. The curved support arm 44 has a generally circular shape with a variable constant radius of curvature extending over at least 180 degrees between the first and second ends. FIG. 11 is drawn to scale and shows the arm 44 having segments with various radii of curvature blended to form a continuously curved arm. The arm 44 extends from one end of base 40 located at an angle of about 10-20 degrees from a vertical plane through axis 20, to a horizontal plane through the axis 20. The arm 44 thus curves through about 250-260 degrees from the base 40 to the beginning of the fingers 46. The curvature is continuous in that it does not change directions and has all radii of curvature on the same (inner) side of the arm 44. Two different radii of curvature (about 1.4 and about 1) account for a majority of the length of the arm 44 and preferably account for over 180 degrees of the arm's curvature. The distal end of the support arm 44 ends with the fingers 46*a*, 46*b* located on opposing sides of longitudinal axis 20, and on opposing sides of a horizontal plane through that axis when the microphone is in that plane. The support arms 44 curve around longitudinal axis 20 and approach closer to that axis at the distal end where fingers 46 engage the microphone body and are further from that axis at the base 40. The arms 44 preferably extend less than 270 degrees and preferably less than 360 degrees from the connection with the base 40 from which each arm extends, with each arm 44 preferably extending in the shape of a spiral or portion of a spiral.

The support arm 44 has a cross-sectional shape configured like an I-beam to provide increased stiffness in the plane of the support arm 44. Other cross-sectional shapes can be used, including box sections and hollow sections. It is believed that a T-shaped cross-section may work, with the cross-member of the T section being outward from the radii of curvature. Thus, support arms 44 may have a cross-sectional configuration along at least half of its length selected from one of an I section, an H section, a T section, a C-section and a closed box section. The curvature of the arm 44 is selected to avoid any localized bending or deformation of the arm sufficient so that the arm hits in inner portion of the first and second cage 30, 32, within which the arm 44 is located, when the supports 44 hold a microphone 14 about 10 inches long weighing about 350 grams, under a 3 g deflection force. The inner portions of the cage 30, 32 are about 0.5 inches from the outer portions of the arm 44, with the inner diameter of the cage 30 being about 3.5 inches. The inner rail 24 has a length sufficient to space the supports 44 apart a distance suitable to hold microphone 14. A rail 24 with a length of about six inches is believed suitable for most commonly used microphones 14, but the length will vary according to the user's needs.

The arm 44 has a distal end to which is attached a holding mechanism that extends inward toward (and preferably past) longitudinal axis 20 in order to hold the microphone during use. At least one and preferably two fingers 46*a*, 46*b* extend from the distal end of the arm 44, with the fingers 46 configured to releasably grip and hold the microphone 14 during use. The fingers 46 are shaped to receive a microphone body 16 (FIG. 1) about ¾inches in diameter with the microphone 14 causing a slight deflection of fingers 46*a*, 46*b*. The fingers 46 engage opposing portions of the microphone on opposing sides of the longitudinal axis 20 during use. The lower finger 46*a* has a V-shape viewed along axis 20, while the upper finger 46*b* has an inverted V-shape when viewed along axis 20. Thus, a first portion of lower finger 46*a* extends downward toward elongated connector 22 on a first side of a plane through the axis 20 and elongated connector 22, while a second portion extends upward away from elongated connector 22 on the opposing second side of the plane through the axis 20 and elongated connector 22. Similarly, a first portion of upper finger 46*b* extends upward away from elongated connector 22 on the first side of the plane through the axis 20 and elongated connector 22, while a second portion extends downward on the opposing side of the plane through the axis 20 and elongated connector 22. The longitudinal axis 20 is preferably, but optionally centered between the apexes of the lower and upper fingers 46. As best seen in FIGS. 2, 3 and 11, the distal end of arm 44 connects to the first portion of the lower finger 46*a* rather than at the juncture of the fingers 46*a*, 46*b*. The lower finger 46*a* is slightly wider along the length of axis 20 than is the upper finger 46*b*.

The distal ends of the fingers 46*a*, 46*b* are preferably spaced apart a distance so that the body of the microphone 14 can be passed through the gap between the ends of the fingers. The distance between the apexes of the fingers are spaced apart a distance such that the first and second portions of each finger abut the body of the microphone during use and are resiliently urged against that microphone body during use so as to resiliently grip it. The fingers 46*a*, 46*b* form a snap fit over the body of the microphone 14. The first and second portions of the fingers 46 are shown as straight, but need not be so. When viewed along axis 20, the fingers 46 form a generally diamond shape with one apex of the diamond being absent to form the gap between the distal ends of the fingers. The fingers 46 abut a generally circular cross-section of the body of microphone 14 at four locations roughly spaced about 30-45° apart so the fingers are resiliently urged against opposing portions of the microphone during use. The distal ends of the fingers 46 are preferably slightly inclined so that the cylindrical wall of a microphone handle may abut the inclined portion to spread the fingers apart and make it easier to insert the microphone between the fingers. The fingers 46 are shown with a solid, generally rectangular cross-section, but with rounded corners. Other configurations could be used.

The microphone base 40 slides along the inner rail 24 and may be releasably fastened in place by various mechanisms, including spring detents, snap locks and threaded fastener mechanisms. As best seen in FIG. 3, a cam latch is used. The microphone base 40 opposite the connection to the arm 44 has a radial slot 48 that intersects slot 42 and is preferably perpendicular thereto. A cam lever 50 is rotatably mounted in the transverse slot 48 by passing rotation cam pin 54 through aligned holes 52*b* in microphone base 40 and hole 52*a* in one end of cam lever 50 so the lever rotates about pin 54. A cam follower pin 56 is fastened to the cam lever 50 by passing the follower pin 56 through hole 58 in the lever. The follower pin 56 is longer than the cam lever 50 is wide so that the ends of the follower pin 56 extend beyond opposing sides of the cam lever 50. A cam surface 60 is formed on opposing sides of the transverse slot 48. The holes 52, 58 are located so that the cam follower pin 56 abuts the cam surface 60 as the cam lever rotates about cam pin 54. A detent 62 is placed at one end of the cam surface 60 to hold the cam lever 50 in the locked position. The cam has distal end 64 and locking end 66.

As the distal end 64 of cam lever 50 is manually moved away from axis 20 and fingers 46 the abutting end 64 moves toward the inner rail portion 24 and elongated connector 22, and the cam follower pin 56 begins to bond on the cam surface 62. When the cam follower pin 56 fits into detent 62 the locking end 66 abuts the support member 22, preferably abutting the inner rail portion 24 so as to fasten the microphone base 40 and arm 44 to the inner rail 24 and elongated connector 22. The detent 62 provides a snap lock to hold the lever 50 in place in a locked position. As the distal end 64 of cam lever 50 is manually rotated toward axis 20 and fingers 46, the locking end 66 is moved away from the slot 42 and inner rail portion 24, thus freeing the microphone base 40 to be manually moved along the length of the rail 24 and elongated connector 22.

By using the releasable fasteners such as the cam lock the distance between arms 44 can be adjusted to accommodate different lengths of microphones 14, and as desired to shift the position of the support arms 44 and microphone along the elongated connector 22. The elongated connector 22 may extend into either or both of the cage portions 30, 32, and preferably extends into both cage portions. The supports 44 are preferably about two inches apart, centerline to centerline, but the distance can vary. The supports 44 are preferably mounted to the rail 24 so the supports curve in opposing directions within parallel planes so the fingers 46*a*, 46*b* open in opposing directions. The supports could be mounted so the supports curve in the same direction with the gap between the fingers 46*a*, 46*b* opening in the same direction. The supports 44 are preferably made of a glass-filled polymer material, such as glass-filed Nylon.

The connecting bracket 28 is shown as a short cylinder that is slit at its bottom, with a mounting foot 70*a*, 70*b* on opposing sides of the slit. The cylinder encircles longitudinal axis 20 during use. The mounting foot 70*a*, 70*b* may each have the same shape, shown here as generally rectangular with rounded corners. A hole 71*a* is formed in each foot 70 with the hole 71*a* sized to pass the shaft 72 of a first releasable fastener 74*a* having a hand gripped head 76. The distal end of shaft 72 is preferably threaded. The elongated connector 22 may have a shaped recess 78 in each opposing side of the elongated connector 22, adjacent one end of the support to receive one of the connector feet 70*a* or 70*b*. A hole 71*b* extends through recess 78 and is sized to pass shaft 72. In use, the feet 70*a*, 70*b* are spread apart and moved along the elongated connector 22 until each foot 70 fits into a mating recess 78. The shaft 72 is passed through aligned holes 71*a*, 71*b* in the feet 70 and elongated connector 22 and the threaded end of shaft 72 engages either threads in the opposing foot or a nut in order to clamp the feet 70 against the elongated connector 22. The feet 70 fitting in the recess 78 help maintain the orientation of the feet and bracket 28, and the fastener 73 keeps the bracket in place.

Figure 14:
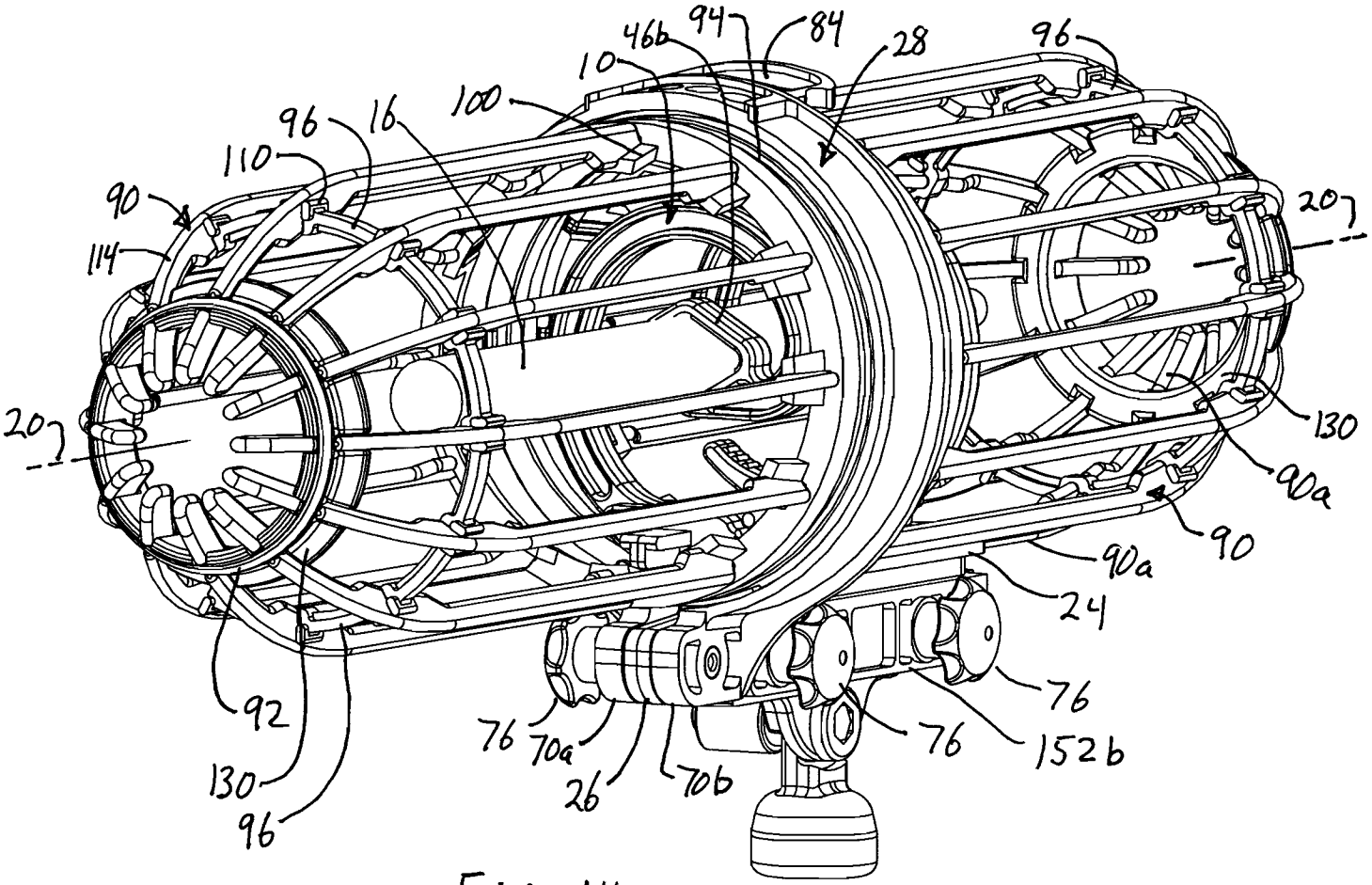
FIG. 14 is an end perspective view of the microphone enclosure and support of FIG. 1, with fasteners on opposing sides of the connecting bracket.

As seen in FIG. 1, the knobs 76 on fasteners 73, 74*a* are close together when the second cage 32 is in the first position abutting connecting bracket 28. That makes it hard to turn the knobs. Referring to FIG. 14, in order to improve access, knob 76 of fastener 73 may be placed on the opposing side of the elongated support 22 as the knobs 76 of fasteners 74*a*, 74*b*.

The cylindrical portion of connecting bracket 28 has an inner and outer surface. A first end of the bracket 28 has threads 80, preferably on the inner, inward facing surface of the bracket. The threads are preferably highly inclined so as to engage in less than one rotation. A flange 82 extends inward and outward from the opposing, second end of the connecting bracket 28. A latch 84 may extend from the connecting bracket 28, past the flange 82 and parallel to axis 20, preferably at a location opposite feet 70*a*, 70*b* and in a direction away from threads 80. The latch 84 is shown as a surface with a protrusion 85 (FIG. 12) on its inward facing side that latches into and releasably engages with groove 95 (FIG. 2) on the outer facing surface of second ring 94*a*. The latch 82 is curved to conform to the curvature of the bracket 28. The latch resiliently engages the g rove 95 to hold the second retaining ring 94*a* (and second cage 32) to the connecting bracket 28. Other types and locations of releasable latches can be used.

As seen in FIG. 2, the feet 70*a*, 70*b* allow the bracket 28 to encircle a first end of the inner rail 24 when the bracket 28 is fastened to the elongated connector 22, locating the rail toward an outer side of the bracket. In use, the first cage portion 30 has threads 86 that mate with the connector's threads 80 to fasten the first cage portion to the bracket 28. The second cage portion 32 fastens to the elongated connector 22 while abutting the flange 82 of the connecting bracket 28 and engaging the latch 82 on the bracket, as described later.

Figure 4:
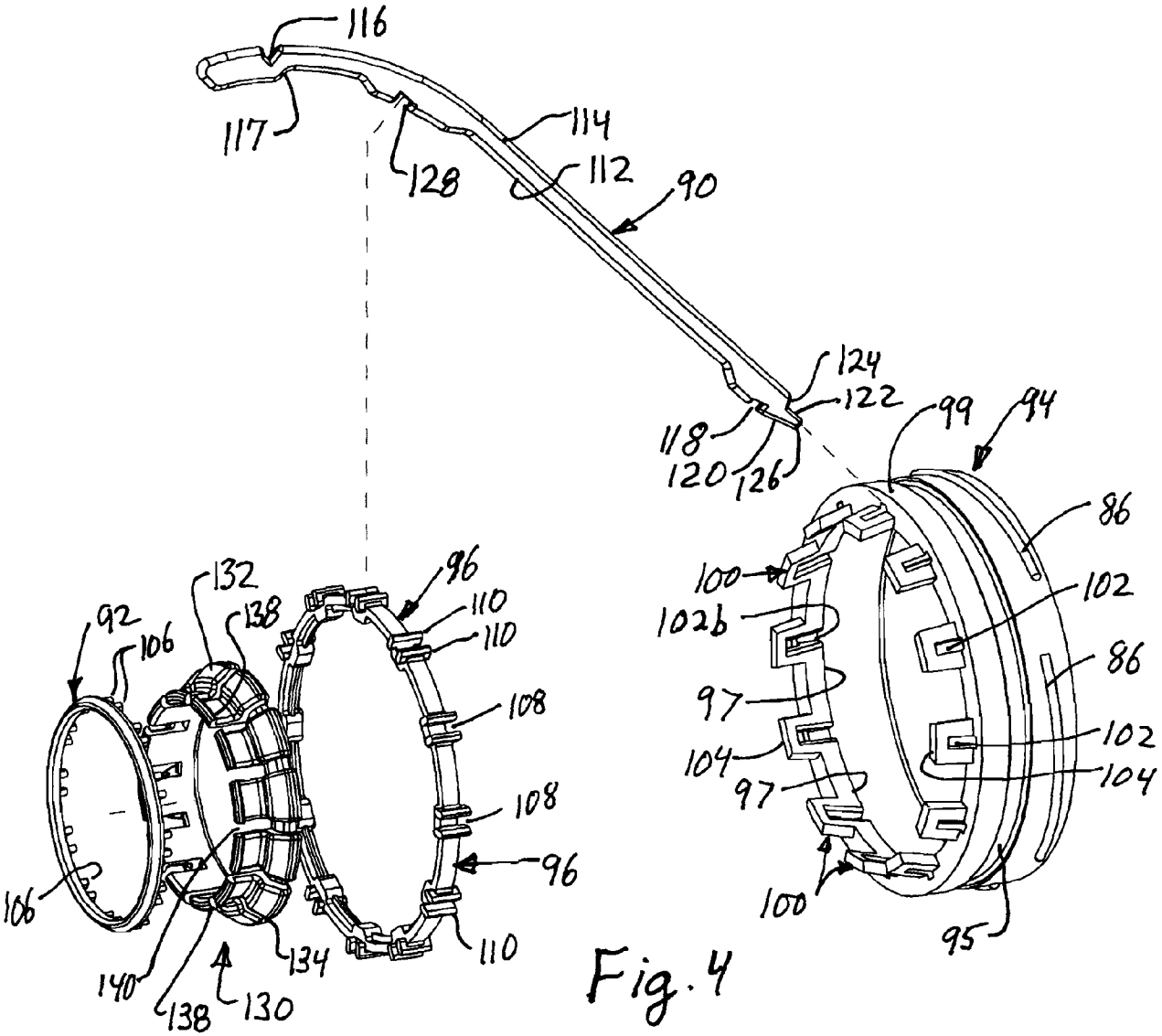
FIG. 4 is an exploded perspective view of a first cage of the microphone enclosure of FIG. 2 with a single rib.
Figure 5:
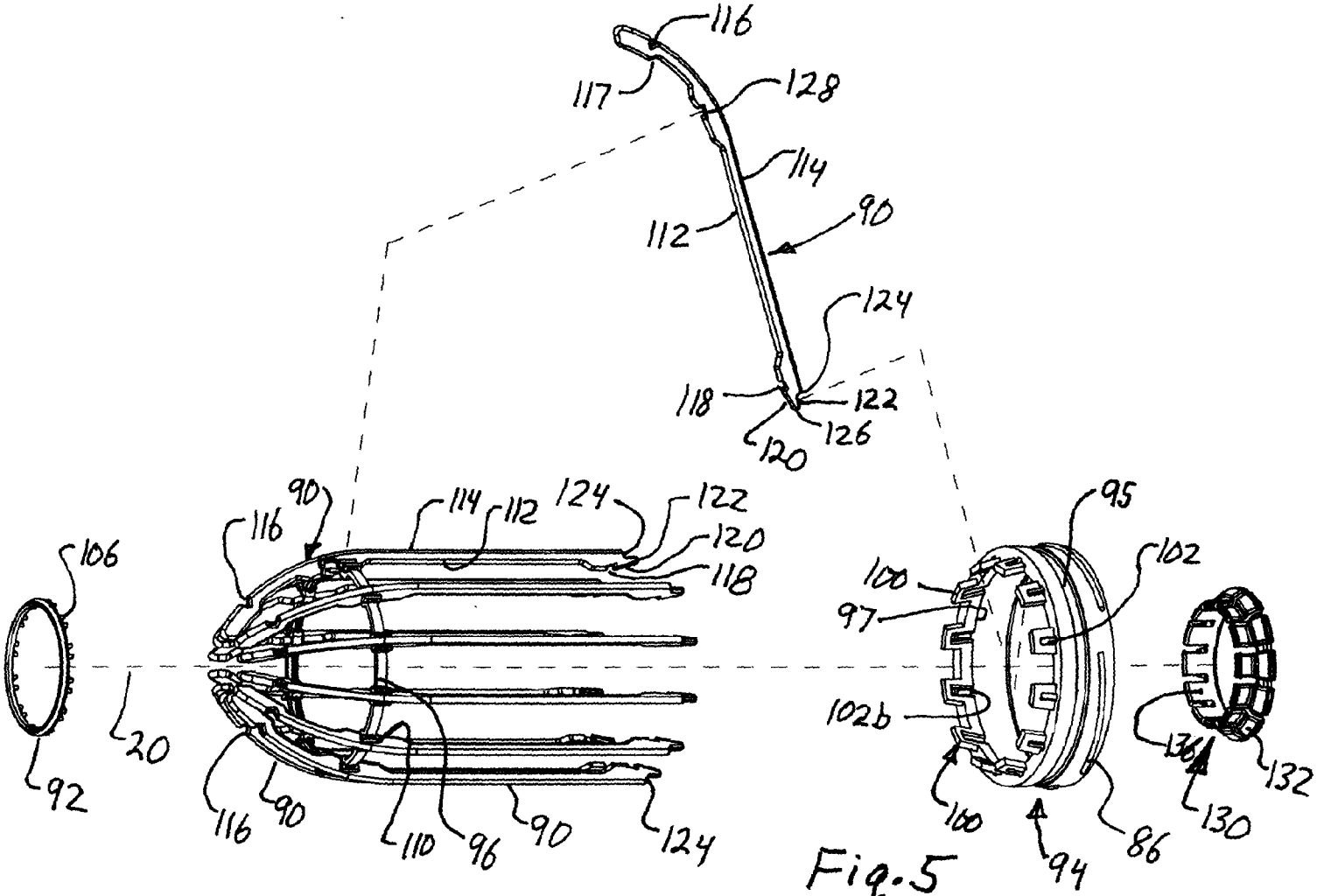
FIG. 5 is an exploded perspective view of a first cage of the microphone enclosure of FIG. 2 with plural ribs.
Figure 7:
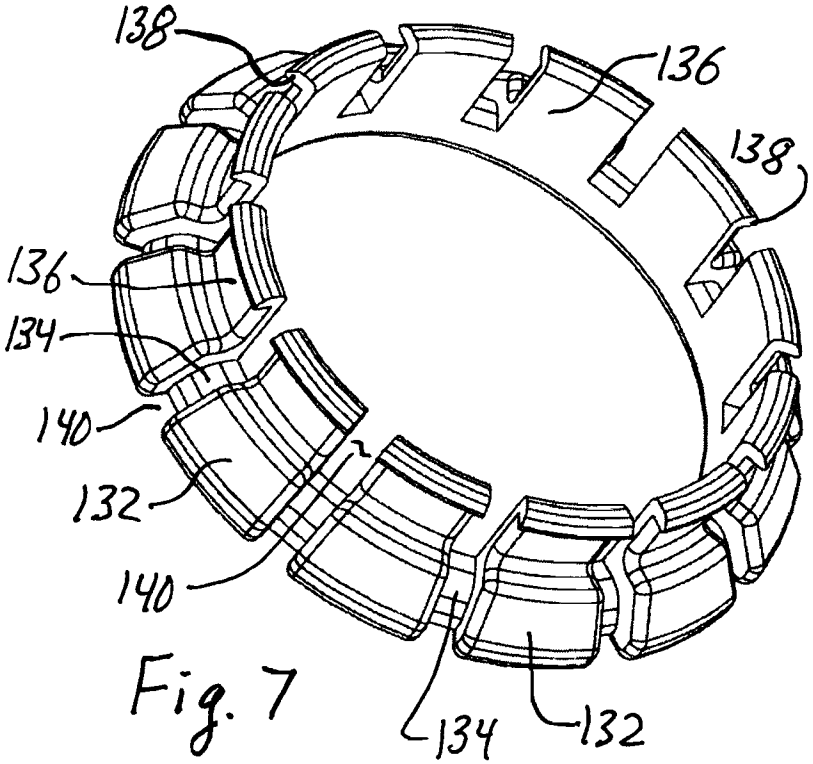
FIG. 7 is a perspective view of a locking ring of the first and second cage portions as shown in FIG. 2.
Figure 6:
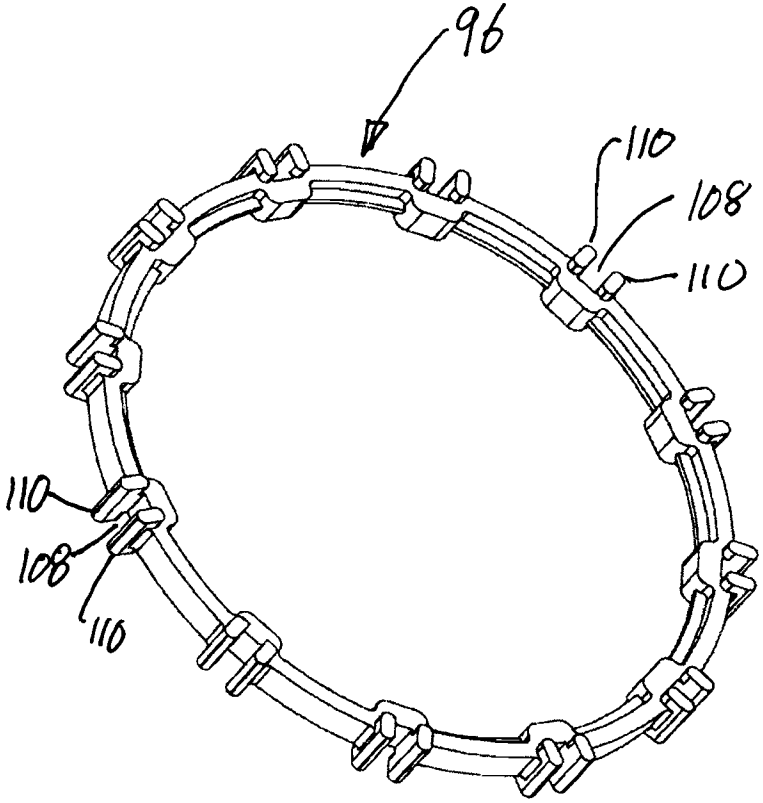
FIG. 6 is a perspective view of a first ring of the first and second cage portions as shown in FIG. 2.

Referring to FIGS. 2 and 4-9, the preferred construction of the first and second cage portions 30, 32 are described. The basic construction is similar and will be initially described with reference to first cage 30 as shown in FIGS. 4-5. The first cage portion 30 has a plurality of elongated ribs 90 each having a distal first end connected to a first restraining ring 92 and locked against that ring by locking ring 130 so the ribs 90 are between the first ring 92 and lock ring 130. The ribs 90 have an opposing second end connected to a second restraining ring 94. Each rib 90 is further connected to a third restraining ring 96 interposed between the first and second rings along the length of the ribs. The first ring 92 is smaller in diameter than the second and third rings 94, 96, respectively. The rings are preferably releasably connected to the ribs 90 in a snap-fit assembly as follows.

The second ring 94 is a base ring that abuts connecting bracket 28 during use. The second ring 94. The second ring 94 is a continuous ring, generally cylindrical in shape with the threads 86 on a recessed portion of the external or outer surface of the second ring 94. The second ring 94 has a first end and an opposing second end, with the second end abutting connecting bracket 28 during use. The first end of ring 94 has a flange 99 extending inward and outward of the wall forming the remaining portion of the second ring 94 and extending axially for a short distance. The distal end of ring 94 abuts the inwardly extending portion of flange 82 (FIG. 2) on connecting bracket 28 to forms a stop that abuts the end of ring 94 and cage 30 during use to limit relative movement of the bracket 28 and first cage 30 and may also set the relative position of those parts.

A plurality of axially extending projections 100 extending away from the flange 99 and toward the first ring 92. When viewed from the inside or outside of the second ring 94, the projections 100 and flange 99 have a crenelated appearance. Twelve projections 100 are shown, equally spaced around the second ring 24 and located on the inner surface of the ring 100. The projections 100 are shown with a rectangular shape with rectangular openings 102 extending radially therethrough relative to longitudinal axis 20. The rectangular openings 102 advantageously but optionally extend into the inner surface of flange 99 so as to form a notched recess 102*b* (FIGS. 5, 7) in the inward facing or inner surface of the flange 99 on the second ring 94, at the first end of the ring 94. Each projection 100 thus as an opening 102 and a notched recess 102*b* extending into the flange 99 and aligned with the opening 102. The notches 102*b* preferably but optionally end flush with the inner surface of the main portion of second ring 94. As seen in FIG. 4, the projections 100 are offset inward from the outer surface of cylindrical second ring 94, and are located around the inner edge of flange 99. There is thus a radially extending portion of the flange 99 extending radially outward from each projection 100 and its associated opening 102. The projections 100 have an inward facing surface that preferably has the same diameter as the inward facing surface of flange 99.

The projection 100 forms a frame around the opening 102. Preferably the frame is substantially the same shape as the opening and since the depicted opening 102 is rectangular the projection 100 is also rectangular with a generally flat top 104 on the projection. The distance between the edge of the top 104 and the adjacent top of the opening 102 may be a predetermined distance to form an interlocking fit as discussed later.

Each opening 102 and its associated notched recess 102*b* are preferably rectangular, having a smaller dimension sized about the same as a thickness of a rib 90 measured in a circumferential dimension during use. The same applies to the notches 102*b*. The openings and notches 102, 102*b*, respectively fit a portion of a rib 90 as discussed later.

The first ring 92 is preferably a continuous ring and preferably has a generally cylindrical inner surface centered about longitudinal axis 20 during use and an inclined outer surface. The outer surface is inclined toward the distal end of the ribs 90 as viewed in FIG. 5. The first ring 92 has a first end and second end, with the second end facing the connecting bracket 28 during use and the first end facing away from that bracket 28 during use. If the first ring 92 has an inclined or tapered outer surface then the exterior surface of the second end is slightly larger in diameter than the exterior surface of the first end.

A plurality of positioning flanges 106 are formed on the second end of the first ring 92. The flanges 106 extend generally radially across the entire second end of the ring 92. The flanges could comprise opposing walls forming a notch in the second end of the ring 92 and the flanges 106 are intended to encompass such opposing walls. The flanges 106 are in height short and spaced apart a distance sufficient to fit on and preferably abut opposing surfaces of a rib 90 during use, as discussed later. There are preferably two ribs 106 for each flange 90. Alternatively, if the flanges 106 are thick in the circumferential dimension, the spacing between flanges 106 is about the thickness of a rib 90 measured in the circumferential dimension during use.

The locking ring 130 is annular and generally conical in shape, having a plurality of spacers 132 extending outward from a circular base ring 134. The spacers have an axially extending offset 136 which is preferably a resilient member or spring member ending in a distal lip or latch 138 that extends outward, away from axis 20. The spacers 132 and axial offsets 136 are separated by gaps or spaces 140 each of which is sized and configured to receive the mating part of a rib 90. In use, a rib 90 fits into each gap 140 with the abutting surfaces of the base 134 preferably conforming to the shape of the abutting portion of the rib 90. The spacers 132 and gaps 140 are preferably sized to snugly receive the mating ribs 90 and hold them in a radial orientation relative to axis 20.

The offsets 136 are sized so they extend axially a distance sufficient so that when the first ring 92 nests in a first notch 116, the latches engage the first surface of the first ring 92 to lock ring 92 to ring 130, and lock the ribs 90 between the rings 92, 130. The offsets 136 are resilient so they may be moved radially to engage and disengage from the first ring 92. The latches 138 are thus resiliently urged radially outward from axis 20 to releasably and resiliently engage first ring 92 and ribs 90 during use to lock the ribs in place between rings 92 and 130.

The outward facing surface of offsets 136 are inset toward axis 20. The ribs 90 have an enlarged distal end beginning just before notch 116, with the enlarged end formed by an inwardly extending shoulder 117. (FIGS. 4-5). The shoulder 117 preferably abuts the ring 134, with the surfaces being shaped to conform to each other. Thus, the locking ring 130 has its latches 138 resiliently engaging first ring 92, has the base 134 on ring 130 abutting the shoulder 117 on rib 90, and has its spaces 132 receiving and enclosing an inward facing portion of the rib 90 so the spacers 132 maintain the spacing and orientation of the ribs. Thus, the first ring 92 is also held in position along axis 20 by the locking ring 130. Advantageously, a rib 90 fits between each pair of flanges 106 on ring 92, with the flanges 106 nesting with or abutting the spacers 132 on each side of the gap 140 into which the ribs 90 fit.

The third, intermediate ring 96 is preferably a continuous ring having a first surface facing ring 92 during use, and an opposing second surface facing ring 94 and bracket 28 during use. The outward facing or outer surface of ring 92 has a plurality of notches 108 formed in the ring with opposing walls of each notch being spaced apart a distance sufficient to fit on and preferably abut opposing surfaces of a rig 90 during use, as discussed later. The notches 108 may include or be formed by flanges 110 extending outward from the third ring 96 with the flanges being located so that the faces of opposing flanges coincide with the faces of the walls forming the notches 108 to form a continuous surface into which the ribs 90 fit as described later.

Still referring to FIGS. 4-5, the ribs 90 may have various shapes depending on the overall shape of the cage portions 30, 32. The depicted ribs 90 and rings 92, 94 and 96 form an elongated cage with generally cylindrical sides and a domed end. Each rib 90 advantageously has the same configuration, with a first end that is curved to form a portion of the domed shape, and a straight portion that forms the generally cylindrical portion of the cage 30. The second end of rib 90 has an opposing inward facing side 112 and an outward facing side 114 relative to longitudinal axis 20. The rib 90 is shown with a cross-section that is generally rectangular in shape, and may have slight caps on the inner and outer edges to increase stiffness and form an I shaped cross-section. Ribs 90 with T-shaped cross-sections, an inverted L shape cross-section, with the cross-member of the T or the short leg of the L forming the outward facing or outer surface 114 and the narrower bottom of the T or long leg of the L forming the inward facing or inner surface 112 may be used. Other shapes can be used, with other flanged shapes being believed suitable, as well as non-flanged shapes such as rectangular (including square), circular and oval cross-sectional shapes (tubular or solid) being believed suitable. The ribs 90 preferably have a non-symmetric cross-sectional shape with one dimension longer than the other to increase bending stiffness about one axis. The ribs 90 are aligned so that the long axis of the cross-section is radial to the axis 20 in order to minimize the blockage of acoustic waves. Thus, the ribs 90 have the smallest dimension of their cross-sectional shape facing the longitudinal axis, and the longer dimension radially aligned to that axis. impinging The first end of the rib 90 has a first notch 116 extending inward from the outer surface 114, with the first notch located on the curved portion but close to the first end of the rib. The exact location can vary. The first notch 116 is configured to mate with the flange 106 on the first ring 92, preferably forming a snap-fit or snap-lock connection, including a slight interference fit. The first notch 116 is oriented so that the inclined outer surface of ring 92 forms a continuous surface with the outer surface 114 of the rib 90. The depicted first notch 116 is two sided with one side generally parallel with axis 20 and the other side generally radial to that axis. But the exact shape of the first notch 116 will vary with the curvature of the first end of the rib 90 and the cross-sectional configuration of the first ring 92.

A second notch 118 is formed in the inward facing surface 112 of the rib 90 adjacent the second end of the rib. The second notch 118 is configured to mate with and preferably form an interlocking fit or snap fit with the top 104 of projection 100, with a portion of the rib 90 extending through the opening 102 in projection 100 to form that fit.

Figure 8:
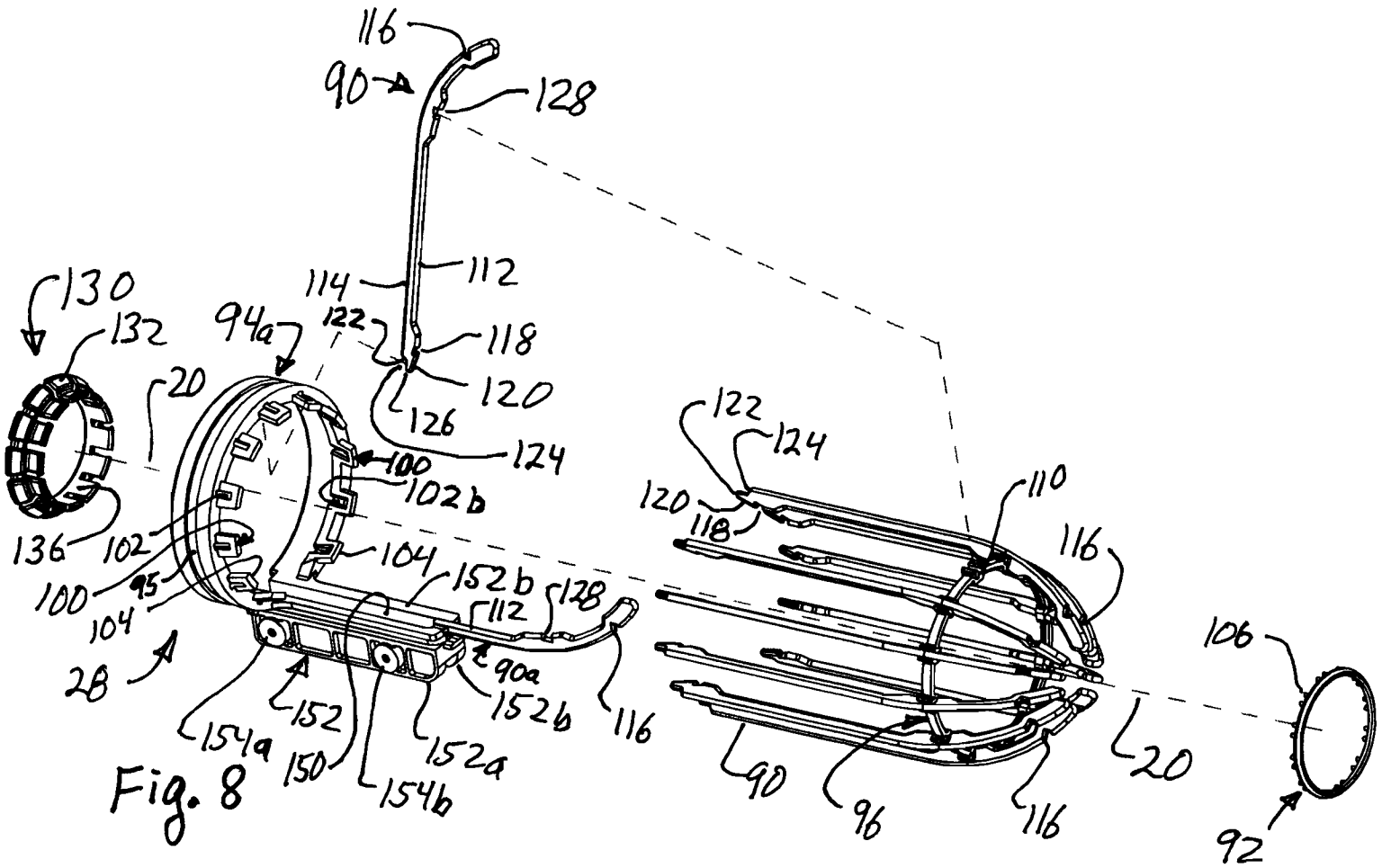
FIG. 8 is an exploded perspective view of a second cage of the microphone enclosure of FIG. 2 with plural ribs.

As best seen in FIGS. 4, 5 and 8, an inner flat 120 extends from the second end of the notch 118 to the second end of the rib 90. The inner flat 120 is on the inward facing side of the rib 90 during use. Opposite the inner flat 120 is an outer flat 122 that extends from the second end of the rib a short distance ending in an outwardly extending or radially extending wall 124. The flats 120, 122 join at a distal second end 126 of rib 90. The flats 120, 122 are configured so that the distal second end 126 is aligned with the inward stepped edge 97 (FIG. 2) of ring 94 during use.

Referring again to FIGS. 2, 4-5 and 8-9, in use, the second end of the rib 90 that is located between the flats 120, 122 is inserted through the opening 102 in one of the projections 100. That second end of the rib 90 is inserted from the outside toward the inside (toward longitudinal axis 20). The first end of the rib 90 is then rotated toward the axis 20 so that the outer flat 122 abuts the inside surface of the second ring 94 and fits within notch **102*b*, while the wall 124 abuts and rests against the surface of flange 99 and the notch 118 abuts the top 104 of projection 100. This also places second distal end 126 at the location of the stepped edge 97 on the inside of the second ring 94**.

The abutment of the outer flat 122 with the inward facing surface of ring 94 and flange 99 and notch **102*b* restrains further rotation of the first end of rib 90 toward axis 20. The engagement of the second notch 118 with the top 104 of projection 100 restrains inward movement of the rib 90 toward axis 20 and also restrains rotation of the first end of the rib toward axis 20. The second notch 118 and top 104 of the projection 100 engage to form a pivot point about which the rib 90 may pivot, but they also limit movement of the second end of the rib. The sides of projection 100 forming opening 102 abut the second end of the rib 90 to restrain lateral motion of the rib, which restrained motion may also be viewed as circumferential motion around the circumference of flange 99 and second ring 94. Fitting the second end of the rib 90 through the notch 102 also restrains rotation about the length of the rib 90. The abutment of the radial wall 124 with the flange 99 restrains motion toward that flange along axis 20, while the engagement of the second notch 118 with the top 104 of projection 100 restrains motion in both directions along axis 20. In short, engagement of the second end of rib 20 with the second ring 94 limits the motion of the rib 90, while allowing some limited rotation of the first end of the rib 90 toward the axis 20 and greater rotation away from the axis 20**.

After mating the second end of the rib 90 with the projection 100 as described above, the first end of the rib 90 is rotated toward the axis 20 so a third notch 128 on the inward facing side of the rib 90 engages the third ring 96. The notch 128 are third ring 96 are configured so they fit together in an interlocking manner, and preferably form a snap fit—including a slight interference fit. When all of the ribs 90 are mated with a projection 100 and second ring 94, and rotated toward axis 20 and mated with third ring 96, then the first ring 92 is mated with the first notches 116 on each rib 90 to hold the assembled cage 30 together. Optionally, the first ring 92 may be used to hold a portion of the ribs 90 in position as others are mated with the second and third rings 94, 96 and then removed and reattached to the prior and newly mated ribs. The connection of the second end of the ribs 90 with the inside of the second ring 94 limits outward movement of the second end of the ribs, and the intermediate or third ring 96 limits inward movement of the first end of the at the second end of the ribs 90, with the first ring 92 connecting to the outside of the first end of the ribs 90 to lock them into position.

Preferably the first ring 92 is slightly smaller than the position of the notches 116 on each rib when the ribs are fastened to the second and third rings 94, 96, so that the affixing the first ring causes the first end of ribs 90 to move inward toward axis 20 to slightly bend each rib. Thus, the first and second rings 92, 94 restrain outward movement away from axis 20 while the third intermediate ring 96 restrains movement inward toward the axis 20. The locking ring 130 cooperates with first ring 92 to releasably lock one end of the ribs in place and in a desired orientation. The slight bending of each rib 90 makes the bent rib act as a spring. Thus, the ring 92 bends each rib 90 slightly to form a tight, spring loaded assembly comprising the cage 30. Further, the outward facing surfaces of the ribs 90 and rings 92, 94 are smooth so that they do not snag any covering placed over the cage 30 formed by those parts.

Referring to FIGS. 1, 4-8, the distal end of ribs 90 are preferably locked in place between the first ring 92 and the locking ring 130. The locking ring 130 is annular and generally conical in shape, having a plurality of spacers 132 extending outward from a circular base ring 134. The spacers have an axially extending spring member 136 ending in a distal lip or latch 138 that extends outward, away from axis 20. The spacers 132 and axial offsets 136 are separated by gaps or spaces 140 each of which is sized and configured to receive the mating part of a rib 90. In use, a rib 90 fits into each gap 140 with the abutting surfaces of the base 134 preferably conforming to the shape of the abutting portion of the rib 90. The spacers 132 and gaps 140 are preferably sized to snugly receive the mating ribs 90 and hold them in a radial orientation relative to axis 20. The offsets 136 are sized so they extend axially a distance sufficient so that when the first ring 92 nests in a first notch 116, the latches engage the first surface of the first ring 92 to lock ring 92 to ring 130, and lock the ribs 90 between the rings 92, 130. The offsets 136 are resilient so they may be moved radially to engage and disengage from the first ring 92. The latches 138 are thus resiliently urged radially outward from axis 20 to releasably and resiliently engage first ring 92 and ribs 90 during use to lock the ribs in place between rings 92 and 130.

The outward facing surface of offsets 136 are inset toward axis 20. The ribs 90 have an enlarged distal end beginning just before notch 116, with the enlarged end formed by an inwardly extending shoulder 117. (FIG. 4). The shoulder 117 preferably abuts the ring 134, with the surfaces being shaped to conform to each other. Thus, the locking ring 130 has its latches 138 resiliently engaging first ring 92, has the base 134 on ring 130 abutting the shoulder 117 on rib 90, and has its spaces 132 receiving and enclosing an inward facing portion of the rib 90 so the spacers 132 maintain the spacing and orientation of the ribs. Thus, the first ring 92 is also held in position along axis 20 by the locking ring 130. Advantageously, a rib 90 fits between each pair of flanges 106 on ring 92, with the flanges 106 nesting with or abutting the spacers 132 on each side of the gap 140 into which the ribs 90 fit.

Because the ribs 90 are bent the inward portion of the ribs is in compression and the outward portion of the ribs is in tension. Likewise, some of the rings are in compression (e.g., rings 96, 130) and some rings are in tension (e.g., rings 92, 94, 94*a*). As used herein, the ring-stiffened rib structure will be referred to as a spring loaded structure since the parts are resiliently urged into position and maintained in position by bending or compressing various parts (e.g., rigs 90, rings 130, 96) and restraining the bent parts in position with one or more rings 92, 94, 94*a*, 96.

The cage 30 is preferably releasably fastened to the connecting bracket 28. In the depicted embodiment this is achieved by engaging mating threads 86 on the second ring 94 and threads 80 on bracket 28. Other releasable connecting mechanisms may be used, including nesting surfaces, laches, interlocking detents, etc. or combinations thereof.

Referring to FIGS. 1, 2 and 8, the second cage portion 32 is constructed very much like the first cage portion 32 except one ring and at least one rib are different. The common parts which will not be described again include ribs 90 and the associated inner and outer surfaces 112, 114 and notches 116, 118, 128 and associated flats 120, 122, wall 124, and end 126. The common parts also include the first ring 92, third, intermediate ring 96, locking ring 130, ribs 90 and the general way in which the second cage portion 32 is assembled and held together, including the use of the locking ring 130 engaging first ring 92 to hold the ribs 90 in position. There are some differences on the second ring and one or more ribs 90 as discussed below.

The second cage portion 32 has a base ring or second retaining ring 94*a* which has a slot 150 in it to form a split ring. The slot 150 allows passage of the elongated connector 22 through the slot as discussed later. Except for the slot 150, the second retaining ring 94*a* is constructed like first retaining ring 94 and thus has a plurality of projections 100 and openings 102 therein, with the projections inset slightly inward of the ring 94*a* toward axis 20 in order to form notched recesses 102. The projections 104 on each retaining ring 94, 94*a* are preferably aligned so the ribs 90 fitting into the openings 102 in the second cage 32 are aligned with the ribs 90 of the first cage 30. The second ring 94*a* is connected to one end of an elongated base 152 that extends parallel to axis 20 toward the first ring 92. The slot 150 extends through most of the length of the elongated support but may optionally have a closed end. The elongated base 152 thus has two sides 152*a*, 152*b* which are preferably mirror images of each other about slot 150.

Referring to FIGS. 2 and 8, the end of the elongated base 152 distal from the second retaining ring 94 has a rib 90*a* extending therefrom. The rib 90*a* has the first notch 116 on the outward facing side 114 of the rib 90*a*. The rib 90*a* also has the third notch 128 on the inward facing side 112 of the rib 90*a*. The rib 90*a* is shorter than the other ribs 90 because it extends from the distal end of the elongated base 152, with the length of the rib 90*a* being such that the notches 116, 128 align in the same plane as the notches 116, 128 of the other ribs 90 on the second cage 32. Thus, the third ring 96 engages notches 96 in the ribs 90, 90*a* to form the second cage 32. Likewise, the first ring 92 and locking ring 130 engage the ribs 90, 90*a* to form the second cage 32.

In the depicted embodiment, the rib 90*a* extends from a closed end of the slot 150 and elongated base 152, with the rib extending along a plane through the middle of the slot 150 and parallel to the elongated base sides 152*a*, 152*b*. It is possible that the elongated base 152 could have two ribs 90*a* extending from the end of the support 152, on opposing sides of that support 152.

Each side 152*a*, 152*b* of the elongated base member 152 has two through holes or bores 154*a*, 154*b*, with the holes 154 being aligned so the shaft 72*a* (FIG. 2) of threaded fastener 74*a*, and shaft 72*b* of fastener 76*b* may pass through the aligned holes 154 and clamp the sides 152, 154 toward each other and narrow the width of slot 150. Thus, the bore 154*a* in elongated base member 152*b* may be threaded, or a nut may be placed on the outside of the member 152*b* to engage threads on shaft 72*a* passing through the two aligned bores 152*a*. The same applies to bores 152*b* and shaft 72*b*.

Figure 9:
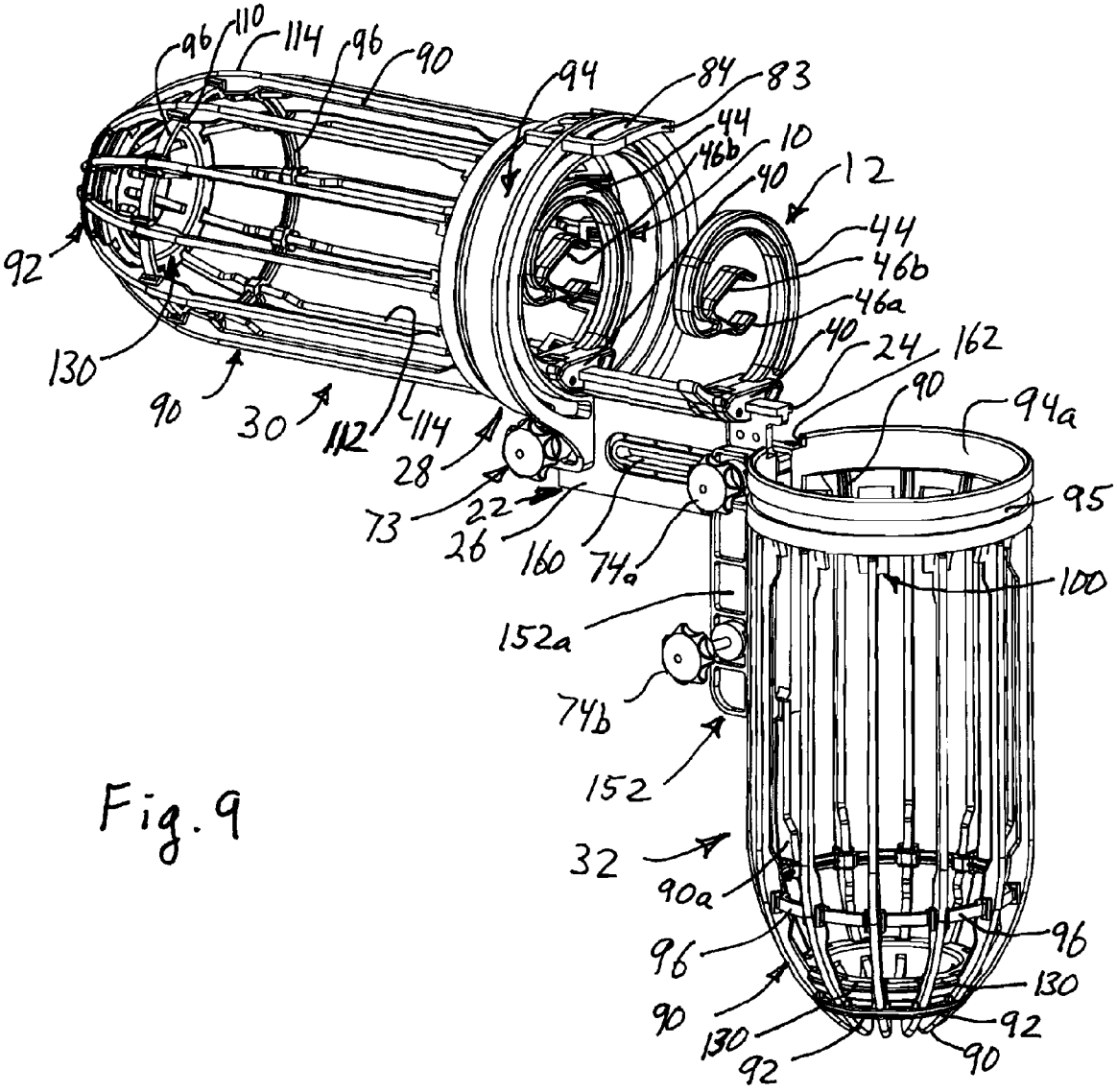
FIG. 9 is a perspective view of the microphone enclosure of FIG. 1 with the first and second cage portions in a third position.

Referring to FIGS. 2 and 9, the elongated connector 22 has an elongated, preferably closed slot 160 generally parallel to inner rail portion 24. The slot 160 is sized to snugly but slidably pass the shaft 70*a* (FIG. 2) of fastener 74*a* which has fastener head 76*a*. The elongated connector 22 has an open ended slot or elongated recess 162 on the same longitudinal axis as slot 160 but separated therefrom. The open ended slot or recess 162 opens onto an end of the connector 22 facing the end of cage 32. The recess 162 is sized to allow passage of the shaft 70*b* of fastener 74*b* with fastener head 76*b*. All of the slot 160 is contained in the elongated connector 22, while slot or recess 162 has one closed end and one open end to allow the shaft 72*b* to enter the slot laterally.

The slot 150 allows the sides 152*a*, 152*b* to fit on opposing sides of the connector 22 so that the inner rail portion 24 is inside the cage 32. Fastener 74*a* with shaft 72*b* passes through bore 154*a* in elongated base member 152*a*, through the slot 160 and into or through the bore 154*a* in base member 152*b*. Rotating head 76*a* and shaft 72*a* clamps the sides 152*a*, 152*b* together against the connector 22 fixes the position of base support 152 relative to the connector 22. Loosening the fastener 74*a* allows the shaft 72*a* to slide along the length of the slot 160 so the second retaining ring 94*a* on base 152 can be moved into a first position (FIG. 1) adjacent to and preferably in engagement with the connecting bracket 28 and held to that bracket by latch 88, whereupon the fastener 74*a* is tightened to fix the position of the base 152 and fix second cage 32 in engagement with the connecting bracket 28. When connecting bracket 28 abuts retaining ring 94*a*, the bracket, the second fastener 74*b* preferably is engaged with open ended slot or notch 162 and tightened in a manner similar to fastener 74*a*. Thus, the second cage 32 is held by two fasteners 74*a*, 74*b* on elongated connector 22, and also held by retaining ring 94*a* through latch 84.

Figure 13:
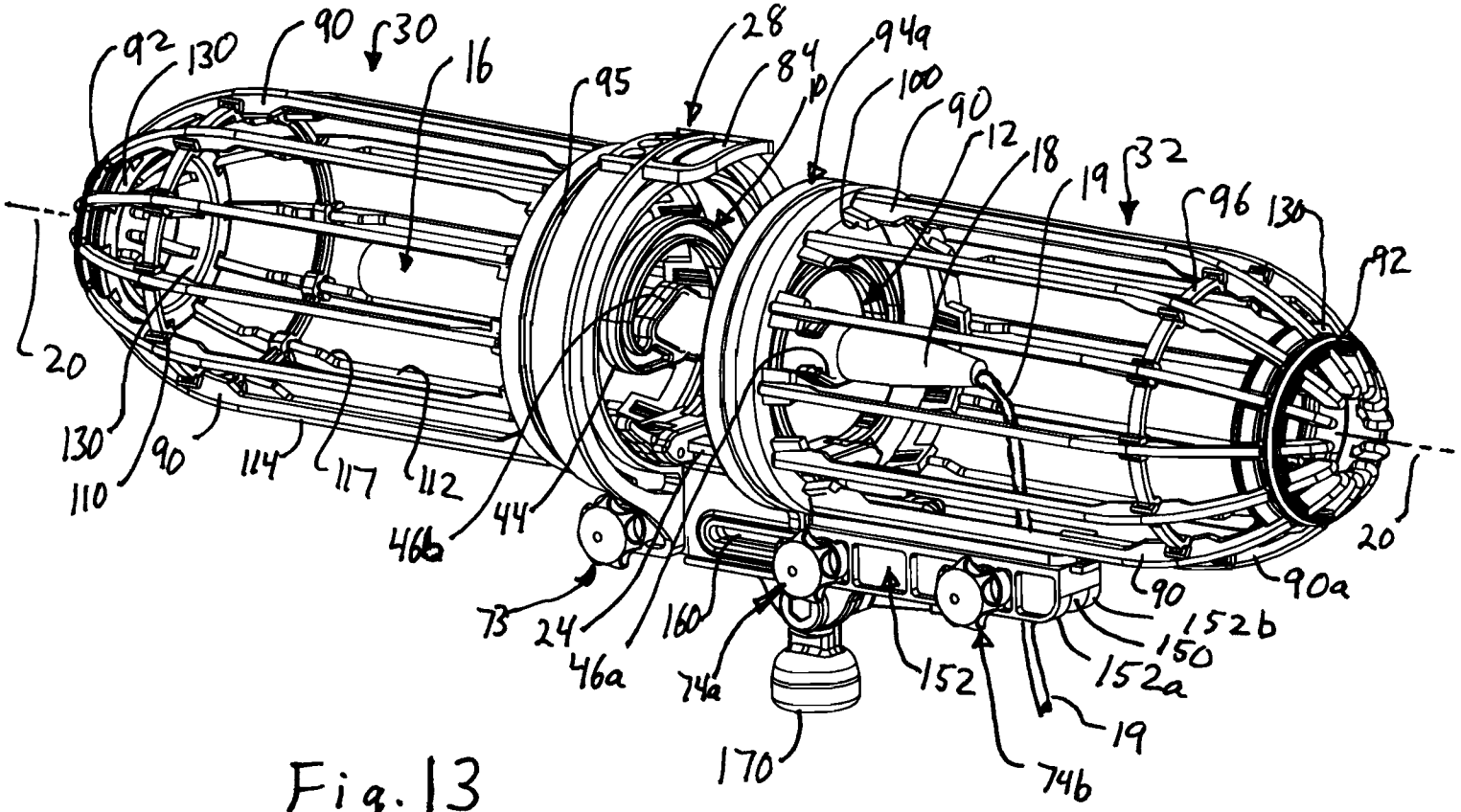
FIG. 13 is a perspective view of the microphone enclosure and support of FIG. 1 in a second position.

Loosening the fasteners 74*a*, 74*b* also allows the shaft 72*a* through the elongated base 152 and open ended slot or elongated recess 160 to slide toward the distal end of second cage 32, to the right as depicted in FIGS. 12-13 into a second position, and then rotated into a third position angled relative to axis 20 (FIG. 9). The rail 24, slot 160 and connector 22 are configured relative to the location of fastener 74*a* that when the shaft 72*a* (and cage 32 and retaining ring 94*a*) moves to a second position (FIG. 12) in which the shaft 72*a* is at or near the end of slot 160 in the connector 22, the second cage 32 and retaining ring 94*a* may be rotated about shaft 72*a* without the ring 94*a* hitting the connector 22 or rail 24. In the second position the cage 32 is still aligned with axis 20. From the second position (FIG. 12) the second cage 32 may be rotated about shaft 72*a* of fastener 74*a* so the axis of the cage 32 is inclined relative to axis 20 (FIG. 9), with an inclination axis of about 90 degrees believed suitable. The ring 94 may have local recesses to mate with any conforming portions of connector bracket 28 or elongated connector 22 or to allow clearance of the elongated connector 22.

As seen in FIG. 9, a slightly recessed area 162 is formed on opposing sides of the slot 150 where the slot joins the free edge of ring 94*a*. The recessed area 162 allows clearance of the elongated connector 22, base 40 and rail 24 as the second cage 32 rotates about shaft 72*a* toward the third position.

When the cage portions 30, 32 both engage the connecting bracket 28 they provide an elongated cage enclosing the microphone 14 in a framework to protect the microphone 14 from damage. Enclosing the cage portions 30, 32 in cover 34 provides a windscreen that may completely enclose the microphone 14 to improve the audio signals from the microphone. Moving the cage 32 to the second position allows limited access to the microphone supports 10, 12 while rotating the cage 32 to the third position allows greater access to the microphone 14 and supports 10, 12, without interference from second cage 32. Thus, the second position (FIG. 9 before rotation)) moves, slides or translates at least one cage portion 30, 32 relative to the other, while the third position (FIG. 9 after rotation) rotates the cage portion out of the way to allow access to the microphone and supports 10, 12. Moving the second cage 32 to the first position encloses the microphone supports 10, 12 and encloses the microphone 14 held by those supports within the cover 34 placed on those cage portions 30, 32 thus restricting access and protecting the microphone from contact and from damage if the assembly is dropped or hits something or something hits it, and protecting the microphone from wind noise via the cover 34 placed over the cage portions 30, 32.

Further, the first cage 30 may be independently removed by unscrewing it from connecting bracket 28 by rotating cage 30, leaving the connecting bracket 28 and second cage 32. Once unscrewed from the connecting bracket 28, care must be taken to move the first cage portion 30 along the longitudinal axis 20 so as not to hit the microphone 14. Alternatively, the bracket 28 may be loosened by loosening fastener 73 sufficiently to release the first cage 30 from the bracket 28. Removal by unscrewing first cage portion 30 or by loosening bracket 28 allows access to any portion of the microphone 14 or microphone support extending into the first cage 30.

It is believed preferably to remove the second cage portion since loosening the fasteners 74*a*, 74*b* to move second cage portion 32 to the second or third positions is believed to be easier and faster than removing the first cage 30 by unscrewing it. Moreover, movement of the second cage portion 32 constrained to move parallel to axis 20 by the shaft 72*a* moving in slot 160, thus providing guided motion of the second cage portion between the first and second position and helping avoid contact of the cage 32 with the microphone 14 during motion between the first and second positions. If the fastener 74*a* were loosened considerably the fastener shaft 72*a* and cage 32 could conceivably rotate in the plane through the longitudinal axis of slot 160 so the cage 32 hits the microphone. But that movement is restrained by the sides 152*a*, 152*b* that clamp against the connector 22 and extend along the length of the connector 22. The sides 152 of the elongated base restrict lateral movement of the base 152 and the cage 32 connected thereto through the second ring 94*a*.

As the shaft 72*a* slides toward the second end of the slot, the end toward ring 92 of cage 32, more lateral movement of the cage 32 may be possible because the overlap of the sides 152*a*, 152*b* with connector 22 are lessened. But the second ring 94*a* may act as a spring member to urge elongated sides 152*a*, 152*b* apart so that a small gap between sides 152 and connector 22 allows movement along the length of the slot 160 and a small gap, and a small gap does not allow much lateral movement of the second cage 32. Thus, the second ring 94*a* resiliently urges the sides 152*a*, 152*b* of the elongated base apart so that slight loosening of fastener 74*a* opens a gap rather than remaining in contact and binding. Note however, that the slot 150 between sides of the elongated base 152*a*, 152*b* is preferably a closed slot with fastener 74*b* located adjacent that closed end so as to clamp the sides 152*a*, 152*b* against the elongated connector 22. Loosening of the fasteners 74*a*, 74*b* allow movement of the cage 32 to the first position and to move the cage 32 from the first position to the second and third positions. Thus, the second cage 32 is preferably held by two fasteners 74*a*, 74*b* clamping the opposing sides of elongated base 152*a*, 152*b* against the elongated connector 22. The second cage 32 is also preferably held by nesting the second retaining ring 94*a* into the connecting bracket 28. These various connections through elongated base 152 and bracket 28 provide a secure engagement with the second cage portion 32. Yet by releasing latch 84 and loosening two fasteners 74*a*, 74*b*, the second cage portion 32 may be readily and easily moved out of the way to allow access to the microphone 14.

Figure 10:
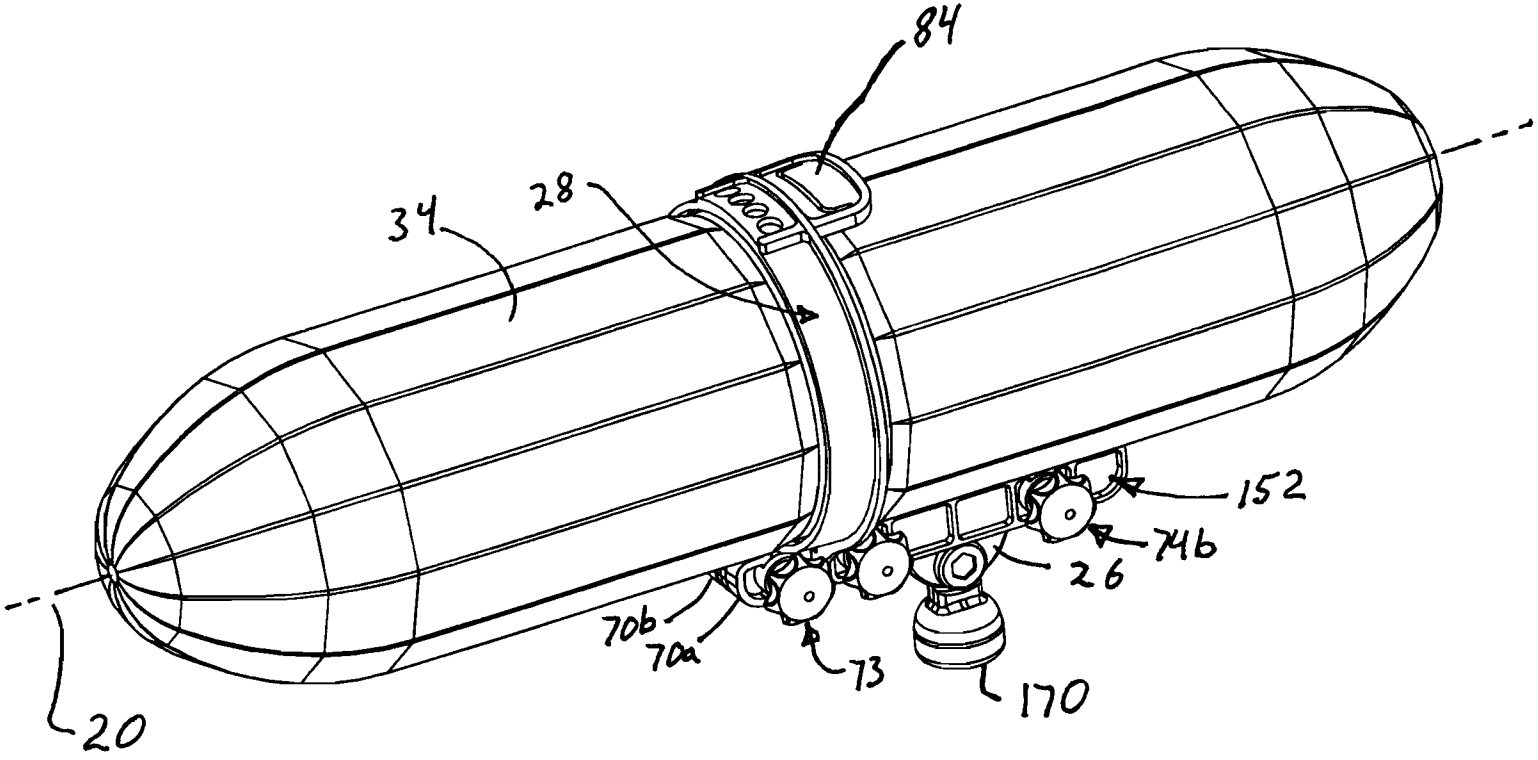
FIG. 10 is a perspective view of the microphone enclosure and support of FIG. 1 with a cover thereon and boom mount.

As seen in FIG. 10, the covering 34 may be provided for the cage portions 30, 32. Windscreen coverings over microphone housings are common, and any such windscreen materials are believed suitable for use with covering 34. Thus, various windscreen coverings may be slipped over the outside of the cage portions 30, 32 or otherwise fastened to cage portions 30, 32.

The cord 19 for the microphone 14 may exit either of the cages 30, 32 at any location between the ribs 90, or a connector (not shown) may be built into connecting bracket 28, second ring 94*a* or first ring 94. As best seen in FIGS. 1-2 and 12, the cable end 18 of the microphone 14 is preferably located in the second cage portion 32. The microphone cord 19 is preferably looped or coiled sufficiently within the cage portion 32 to allow sufficient length to allow for movement of the cage portion between the second and third positions. The cord 19 passes through slot 150 (FIG. 2) between the elongated base members 152*a*, 152*b*. The cord 19 also preferably passes through slot 150 toward one end of the slot, and preferably between the fastener 74*b* and the closed end of the slot 150.

Referring to FIGS. 1, 2, 5, 8-10, and 12-13, the cage portions 30, 32 may be made of metal or polymer materials, graphite epoxy, glass-filed polymer or combinations of those materials are believed suitable. Rings 92, 46, 96 and 130 made of polycarbonate with ribs 90 and connecting parts 22, 28, 152 made of a glass-filled polymer material such as glass-filed Nylon are believed advantageous. The cage portions 30, 32 allow a lightweight, protective enclosure for the microphone 14 and a framework for cloth 34 to form a windscreen, while the quick release of latch 84 and fasteners 74*a*, 74*b* allow easy and fast movement of the second cage 32 between the first, second and third positions for ready access to the microphone. The microphone supports 10, 12 provide a resilient but vibration absorbing support for the microphone 14, with the fingers 46 allowing insertion of the microphone along the axis 20 through the fingers, or laterally by spreading the fingers apart to insert the microphone, or combinations thereof. The individual microphone supports 10, 12 may be positioned relative to each other on the inner rail 24 of elongated connector 22 to accommodate long or short handled microphones 14 or to provide a spread-apart support or a closer spaced support for the microphone. The microphone supports 10, 12 may be shifted toward one end of the inner rail 24 as desired, for example to accommodate a microphone with a longer handle or a longer sensor end 18. The specific configuration of the microphone supports 10, 12 are believed to provide improved support for the microphone 14 and to insulate the microphone sensor 18 from signal distortion by vibrations.

The rings 92, 94, 96 are shown as circular and that shape is preferred since it places the various corresponding portions of the ribs 90 equidistant from axis 20 and that is believed to help reduce the distortion of sound by the cage portions 30, 32. But other shapes can be used, including oval rings, square rings and triangular rings (preferably with rounded corners). The ring-stiffened ribs form a lightweight, strong structure to encircle and protect the microphone 14 during use. The supports 44 provide vibration isolation while also allowing movement of the microphone, but with the supports configured to limit microphone movement so it does not hit the enclosing cage portions 30, 32. A gap of about 0.5 inches between the outer portion of support arms 44 and the adjacent inner portions of cage portions 30, 32 is believed suitable for normal uses.

There is also advantageously provided a method of supporting and enclosing a microphone 14. The microphone 14 is resiliently gripped by fingers 46*a*, 46*b* on opposing sides of the microphone. The fingers 46 are resiliently supported by at least one and preferably two curved arms 44 that curve about more than 180 degrees of the longitudinal axis from base 40, and that preferably extend through a continuous arc of about 210-270 degrees, and more preferably through an arc of about 220-250 degrees from the base. The arm 44 preferably connects to the base 40 offset from a vertical plane through the axis 20 and through the bends of the fingers 46*a*, 46*b*, from a location below the horizontal plane, or less preferably above the horizontal plane. The gap between the distal ends of the fingers 46 preferably opens in a horizontally direction so the microphone can be slipped through the gap horizontally or along the axis between the fingers.

The method preferably includes spacing the supports 44 a desired distance apart by actuating a clamping mechanism such as cam lever 50 to fasten the base 40 to the rail 24 or elongated connector 22. The method may include orientating the arms 44 symmetrically (FIG. 1, 2, 9), or facing opposing directions (FIG. 13). The elongated connector 22 may in turn be connected to various booms, tripods or other support structures by known connections 170 (FIGS. 12-13) which are part of or otherwise connected to elongated connector 22. The movable bases 40 allow the supports 44 and microphone 14 to be positioned along the length of elongated connector 22, within the protective enclosure formed by cage portions 30, 32.

The method includes forming the protective enclosure for the windscreen cover 34 in which a plurality of the parts forming the enclosure are spring loaded against each other. Thus, the method may include bending a plurality of ribs 90 and restraining them in position by one or more rings 92, 94, 94*a*, 96, 130 to spring load the ribs against one or more of the rings. The ribs and rings are resiliently urged against one another, providing a spring-loaded cage portion 30, 32.

The protective enclosure may be formed by joining cage portions 30, 32, preferably through connecting bracket 28. One of the cage portions 32 is movable between at least two and preferably three positions, with the first position being one in which retaining ring 94*a* engages the connecting bracket 28 to form an elongated enclosure with portion 30 to encircle axis 20 and enclose microphone 14 during use as shown in FIGS. 1 and 10. The method includes moving the second cage portion 32 to a third position in which the cage portion is separated from the first portion 30 and rotated out of alignment with longitudinal axis 20 as shown in 9. In this third position the retaining ring 94*a* is preferably to one side of the longitudinal axis 20, preferably below that axis and more preferably below the plane of the inner rail 24. The method also includes moving the second cage portion 32 to a second position as shown in FIG. 12-13 in which the cage portion 32 is separated from the first cage portion 30 and connecting bracket 28 by a gap, but the cage portion 32 is still encircling and preferably aligned with longitudinal axis 20. This second position allows some limited access to the microphone 40 and support 44, but not as much access as the third position. Placing the cover 34 over the cage portions 30, 32 may be done after the portions are separately assembled, with a separate cover portion over each cage portion. Alternatively, the covers 34 may be placed over the cage portions 30, 32 after the cage portions are connected to the connecting ring 28. The covers 34 may be removed at any time as the user prefers.

The microphone support 44 (FIG. 3, 11) continually curves about and continually approaches nearer to the longitudinal axis 20, without any recurvature in an opposing direction, forming a spiral or portion of a spiral structure. The curved or spiral shape provides a resilient suspension. The material used for the supports 44 and the cross-sectional shape of the supports 44 and the curved shape and length of the supports 44 are selected not only so that the movement of the microphone is restrained to prevent it from hitting the enclosing cage portions 30, 32, but selected to reduce the transmission of low frequency handling noise and rumble. The spaced apart supports 44 cooperate to resist rotation and translation about the two axes orthogonal to longitudinal axis 20, especially when the supports are not symmetrically mounted on rail 24, but are mounted so the arms 44 curve in opposing directions. Translation along the longitudinal axis 20 and rotation about that axis 20 are restrained by frictional gripping of the microphone 14 by the fingers 46*a*, 46*b*. As desired, elastomeric pads may be over-molded on the inside of the fingers 46, or elastomeric sheaths or tubes may be slipped over the fingers 46 to increase the frictional grip the fingers exert on the microphone 14.

Making the supports 44 out of glass-filled polymer helps reduce the transmission of vibration to the microphone, especially low frequency handling noise and low frequency rumble. The elastomeric pads or sheathes on fingers 46 also help with vibration isolation of the microphone 14 and dampening of vibrations to and from the microphone.

The use of positionable bases 40 (FIGS. 2, 3) on each microphone support 10, 12 allows the supports to be independently positioned along the length of rail 24, thus allowing the location of the supports along the length of the microphone body 18 to be varied as desired. The movable supports 44 also allow positioning the microphone 14 within the windscreen formed by cage portions 30, 32, and further allows supporting different microphone bodies, differently. The movable supports 44 also allow ready accommodation of short or long microphones. As desired, the base 40 and its attached microphone 14 may be easily and quickly removed by releasing cam levers 50 so the entire base 40 and attached support arm 44 and replaced with a different base and support having differing stiffness and/or vibration damping properties, or having different fingers 46 to grip different microphones or grip them differently.

Fingers 46*a*, 46*b* (FIGS. 3, 15*a-f*) form a diamond-shape enclosure open at one end allow ready insertion and removal of microphone bodies, especially microphone bodies having two circular sides joined by two opposing flat surfaces. The fingers 46*a*, 46*b* grip the microphone 14 on opposing sides of the body 18 sufficiently tight to restrain sliding of the microphone along the longitudinal axis, preferably even when that axis is vertical. Over-molding fingers 46 with an elastomeric or rubber material may increase the frictional grip to facilitate that holding. The over molding may also help with vibration dampening and isolation.

The cage portions 30, 32 use a ring-stiffened rib structure and that provides a very light frame to enclose the microphone 14 and microphone supports 44 when a windscreen cover 34 is placed over the cage portions. The ribs 90 are radially aligned to reduce the acoustic blockage of sound waves impinging radially on the longitudinal axis. The generally symmetric arrangement of the rings and ribs reduces audio distortion. The ring-stiffened rib structure of the cages 30, 32 also provides a very strong structure that resists movement under wind loads and that reduces creaking and noise. Locating the rings 92, 94, 94*a*, 96, 130 to keep the ribs 90 slightly bent provides a spring-loaded structure that keeps the ribs resiliently urged against the rings and provides a continually stressed enclosure that further helps reduce creaking and noise generation by the enclosure. Using a resilient material for the cover 34 may further help compress the cage portions 30, 32 and further reduce movement and creaking of the cage structure enclosing microphone 14 during use. The ring-stiffened, longitudinal rib construction allows the elimination of adhesives and rubber bands to hold the parts together, thereby increasing reliability and longevity while reducing assembly time and lowering costs. Moreover, the snap-together, ring and rib structure allows ready replacement of damaged ribs and/or rings, so that windscreens only partially damaged may be repaired rather than discarded.

The light weight of the resulting windscreen and microphone support makes it easier to position the microphone 14, support 44 and enclosure (30, 32). The light weight helps reduce the sway and movement when the parts are mounted on the end of a telescoping boom as is common. The light weight decreases settling time when the parts are repositioned. The ring-stiffened rib construction also enables the cage portions 30, 32 to be of various diameters or sizes while still reducing the windscreen weight, and that allows the enclosure of a relatively large volume of dead air around the microphone, providing sound deadening insulation around the microphone during use. Making the parts forming the cage portions 30, 32 out of glass-filed polymer further helps reduce vibration generation and transmission. Other sound-deadening material may be used.

The releasable connection of the ribs 90 and rings 92, 94, 94*a*, 96, 130 forming the cage portions 30, 32 allow one or both of the two cage portions that form the windscreen to be easily and quickly opened or removed in order to allow access to the microphone 14 mounted within the enclosure formed by those parts. By sliding one cage portion 30, 32 away from the other along rail 24, a quick but limited access is allowed. By rotating one cage portion (e.g., 32) out of the way one entire end of the microphone and at least one support can be completely exposed for access. That allows rapid and easy access to and replacement or repair of microphones. The resulting access does not require complete removal of the windscreen as the cage portion 32 is still attached to the connector 22 and thus not subject to the risk of separation and loss. It also removes the need to set the separated windscreen somewhere safe since cage portion 32 is hinged to the elongated connector 22. As desired, both cage portions 30, 32 can be removed from the connecting bracket 28 quickly (by completely unscrewing fasteners 73, 74*a*, 74*b*), yet also quickly reconnected to provide a sturdy, lightweight windscreen for the microphone.

Referring to FIGS. 1 and 10, the cover 34 is shaped to conform to the general shape formed by the rib and ring structure of the cage portions 30, 32, so there is preferably a cover 34 for each cage portion. The cover 34 comprises a dome-shaped sheet of material preferably of thin and flexible material. The cover 34 may be fastened to its cage portion 30, 32 various ways, including an elastic band around the open end of the cover fitting into groove 95 in ring 94 or 94*a*. Alternatively, the open, generally circular end of the cover 34 may be fastened to a split ring sized to be resiliently engaged in the groove 95. Alternatively, the cover may have a slot to fit below the T-shaped rail portion 24, with a plastic strip having a slot to fit below the rail 24 and provide a mechanical connection of the cover with the elongated connector 22.

Referring to FIGS. 15*a*-15*f*, the support 44 and fingers 46 may have various configurations, a few of which are illustrated in these Figures. The fingers 46 are further defined as having a first portion or base 180*a*, 18*b* and a second portion or tip 182*a*, 182*b*. The bases 180*a*, 180*b* are joined to form a V-shaped orientation of first portions 180*a*, 180*b*. The tips 182*a*, 182*b* join the bases 180*a*, 108*b* at an angle and are inclined thereto. The first and second portions are both preferably straight, so the juncture of first and second portions 180, 182 also forms a V shape.

Figures 15A, 15B, 15C, 15D, 15E, 15F:
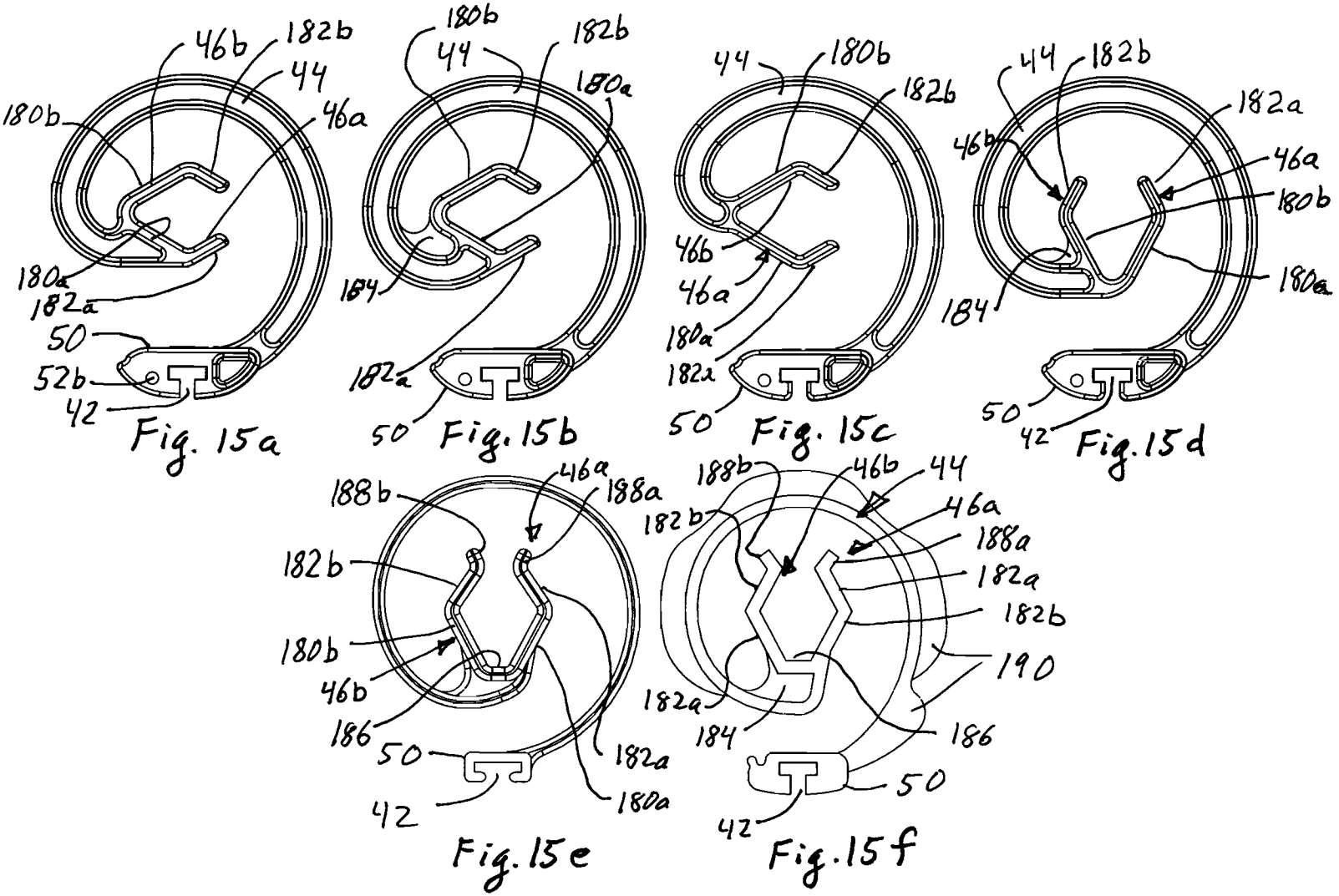
FIGS. 15*a*-15*f* are a series of plan views of various alternative configurations for microphone supports.

FIG. 15*a* is the configuration depicted in FIG. 2, and has the distal end of arm 44 connecting generally horizontally along the length of first portion 180 of finger 16*a*, which first portion 180 is downwardly inclined in this embodiment. The juncture of the arm 44 and first portion 180 is before the juncture with the upwardly inclined second portion or finger tip 182. FIG. 15*b* has the end of arm 44 upwardly inclined and connecting along only a portion of a lower end of the downwardly inclined first portion 180*a* of finger 16*a*, with a thin webbed rib 154 connecting the remaining length of that downwardly inclined first portion 180*a* of finger 16*a*. By thin, the thin webbed rib 184 is less than half the width of the adjoining arm 44. FIG. 15*c* shows the fingers 46*a*, 46*b* extending directly from the distal end of arm 44, along the horizontal axis, with the arm 44 connecting at the juncture of the first portion of fingers 180*a*, 180*b*. FIG. 15*d* has the fingers 46*a*, 46*b* extending vertically from the distal end of arm 44, with the arm extending almost to the vertical plane through longitudinal axis 20 but joining the lower portion of the first second 46*b*. A short and thin rib 184 optionally extends from the distal end of arm 44 to adjacent portions of the first portion 180*b* of finger 46*b*.

FIG. 15*e* has the fingers extending vertically on opposing lateral sides of axis 20, with the distal end of arm 44 extending below the axis 20 and facing upwards. In this embodiment the first portions 180*a*, 180*b* are joined by a generally horizontal segment 186 to space the arms 46*a*, 46*b* further apart, with re-curved guides 188*a*, 188*b*, at the distal ends of second portions 182*a*, 182*b*, respectively. In this embodiment, the base 50 is greatly simplified and merely comprises a housing with a recess 42 configured to slidably receive the rail 24, which is preferably T-shaped. In this embodiment, arm 44 has a simplified cross-sectional shape, preferably a solid cross-section except at the juncture with the base spacer 186 where a flanged cross-sectional shape may be used. The embodiment of FIG. 15*f* is similar to FIG. 15*e*, except the arm 44 has an inward facing portions having a rectangular cross-sectional shape with a single, outwardly extending stiffening flange 190 to form a T-shaped cross-section for arm 44. The flange 190 is reduced in height at locations where the stiffness of the arm 44 is to be decreased to decrease the cross-section and corresponding stiffness in order to make the arm 44 more flexible but at predetermined locations corresponding to the reduced cross-section of arm 44. The flange 190 does not extend into the gap between the arm 44 and the base 50 as the microphone body may pass through that gap. A web 184 may extend between the arm 44 and the adjacent portions of first finger portion 182*a* and base 186. In this embodiment the portions of the fingers 46*a*, 46*b* are joined at sharper angles, rather than having curved junctures which is preferred and shown in the other embodiments.

The configurations of FIGS. 15*a*-15*c* are preferred because the microphone body is through the gap between tips 182*a*, 182*b* of fingers 46*a*, 46*b*. Orienting that gap to be vertical allows a user to slide the microphone body horizontally between the base 50 and fingers 46, and through about 90 degrees of curvature of the base 50 and arm 44, before reaching the gap in the fingers where the microphone body is inserted laterally. The other configurations require further manipulation of the microphone relative to the arms to reach the entrance to the fingers 46 so the microphone body is inserted vertically. Also, the space between the distal end of fingers 46 and the inner facing portion of arm 44 opposite those fingers determines the size of the microphone body that can reach the gap between the fingers for insertion into fingers 46*a*, 46*b*. The microphone may be inserted along axis 20 rather than inserted laterally (FIGS. 15*a*-15*d*) or vertically (FIGS. 15*e*-15*f*) but that is more time consuming. The inside surface of arms 44 provide a guide against which a user can hold the microphone body and move the body to the entrance of the fingers 46. Many microphone bodies have two rounded sides joined by two flat sides, and this configuration is believed to more easily fit into the V-shape recess formed by fingers 46*a*, 46*b* than is a body with a cylindrical cross-sectional shape.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious, modifications and equivalents thereof. In particular, the above description describes a microphone 14 mounted in the enclosure formed by cage portions 30, 32. But other devices can be mounted therein, including various electronic or optical sensors. Likewise, the cage portions 30, 32 can be removed as desired and only the microphone mounting portions 44 used to hold a microphone or other electronic or optical instruments. Thus, while the parts are referred to herein as a microphone mounts 10, 12 and microphone 14, the parts are not limited to microphones but are to include any electronic or optical instrument and the reference to a microphone herein is not to be so limited unless expressly defined otherwise or specified otherwise. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A support for a microphone having a longitudinal axis, comprising an elongated connector having an inner rail portion and an outer connecting portion;

first and second microphone mounts, each microphone mount comprising:

a base configured to movably fasten to the elongated connector along a length of the elongated connector; and a curved support arm having a first end connected to the base and a second end connected to a holding mechanism configured to engage opposing portions of the microphone on opposing sides of the longitudinal axis during use, the curved support arm having a shape forming a portion of a spiral and extending over at least 180 degrees between the first and second ends and encircling at least a portion of the longitudinal axis, the curvature of a midline of the curved support arm defined by a plurality of radii located inside the support arm;

an elongated connector having an inner rail portion and an outer connecting portion;

first and second microphone mounts, each microphone mount comprising:

a base configured to movably fasten to the elongated connector along a length of the elongated connector; and a curved support arm having a first end connected to the base and a second end connected to a holding mechanism configured to engage opposing portions of the microphone on opposing sides of the longitudinal axis during use, the curved support arm having a circular shape extending over at least 180 degrees between the first and second ends and encircling at least a portion of the longitudinal axis, the curvature of a midline of the curved support arm defined by a plurality of radii located inside the support arm, wherein the base has a rotating cam lock to releasably fasten the base to the elongated connector which elongated connector has a rail that is generally parallel to the longitudinal axis during use and to which rail the base is movably engaged so as to be positionable along a length of the rail.

2. The support of claim 1, wherein the holding mechanism comprises two opposing fingers, each finger having an inner and outer portion extending in opposing directions and having a free distal end, the ends of the fingers being spaced apart a predetermined distance, the fingers resiliently urged against opposing portions of the microphone during use.

3. The support for a microphone of claim 2, wherein the fingers have an elastomeric material located to contact a microphone held by the fingers during use.

4. The support of claim 1, wherein each curved support arm is mounted in an opposing orientation so the curved support arms curve in opposing directions with the predetermined distance between the ends of the fingers opening in opposing directions.

5. The support for a microphone of claim 4, wherein the fingers have an elastomeric material located to contact a microphone held by the fingers during use.

6. The support of claim 1, wherein there are two radii of curvature R between about 1 and 1.5 that extend over 180 degrees of a length of the midline of the curved support arm.

7. The support of claim 1, wherein each support arm has a cross-sectional configuration along at least half of its length selected from one of an I section, an H section, a T section, a C section and a closed box section.

8. The support for a microphone of claim 1, wherein the support arm is made of a glass-filled polymer.

9. A support for a microphone having a longitudinal axis, comprising an elongated connector having an inner rail portion and an outer connecting portion;

first and second microphone mounts, each microphone mount comprising:

a base configured to movably fasten to the elongated connector along a length of the elongated connector; and a curved support arm having a first end connected to the base and a second end connected to a holding mechanism configured to engage opposing portions of the microphone on opposing sides of the longitudinal axis during use, the curved support arm having a circular shape extending over at least 180 degrees between the first and second ends and encircling at least a portion of the longitudinal axis, the curvature of a midline of the curved support arm defined by a plurality of radii located inside the support arm; and a windscreen having a protective cage with first and second cage portions each configured to connect to a different one of the inner and outer portions of the elongated connector, at least one of the cage portions being configured to be movably fastened to the elongated connector during use, each cage portion configured to encircle the longitudinal axis and a microphone located on that axis during use, each cage portion having a cover thereon formed of a material selected to allow the passage of sound through the cover.

10. The support of claim 9, wherein each cage portion has a plurality of elongated ribs having a distal end connected to a first restraining ring and an opposing end connected to a second restraining ring, each rib being further connected to a third restraining ring interposed between the first and second rings, the first ring being smaller in diameter than the second and third rings, the second restraining rings being releasably connected to a mounting bracket.

11. The support of claim 9, wherein the ribs each have an inner edge and an opposing outer edge with the inner edge closer to the longitudinal axis during use, and wherein the first and second rings connect to one of the first or second edges and the third ring connects to the other of the first or second edges.

12. The support of claim 9, wherein the ribs each have opposing inward facing and outward facing sides relative to the longitudinal axis during use, and the first and second rings connect to the outward facing side of ribs and the third ring connects to the inward facing side of the ribs, with a locking ring engaging an inward facing side of the ribs and releasably engaging the first ring.

13. The support of claim 9, wherein the elongated connector has an inner and outer portion and the first cage portion has the second ring connected to a mounting bracket that is connected to the outer portion of the elongated connector during use, the mounting bracket forming an opening through which part of the inner portion extends during use.

14. The support of claim 13, wherein the second cage portion has the second ring movably connected to the outer portion of the elongated connector during use with the second ring of the second cage portion being further releasably connected to the mounting bracket.

15. The support of claim 14, wherein the second cage portion has an elongated base having a slot therein releasably engaging the elongated connector to position the second cage portion relative to the inner portion of the elongated connector during use.

16. The support of claim 15, wherein the second cage portion has a fastener with a shaft that extends through a slot in the elongated connector so the shaft and second cage portion can move along a length of the slot.

17. The support of claim 15, wherein the second cage portion is rotatably connected to the elongated connector so as to rotate relative to the elongated connector about an axis orthogonal to the plane containing the elongated connector to provide access to an inside of the first cage portion.

18. The support of claim 9, wherein the first and second cage portions are connected to the elongated connector, the cage portions having a first position with the cage portions encircling the longitudinal axis and enclosing the microphone supports within the cage portions, a second position in which the cage portions encircle the longitudinal axis and the second ring of each cage portion is spaced apart a predetermined distance by a gap, and a third position in which the second portion is rotated at an angle relative to the longitudinal axis and allows access to at least one support arm.

19. The support for a microphone of claim 9, wherein the support arm has a T-shaped cross-section.

20. The support for a microphone of claim 9, wherein the support arm has an I-shaped cross-section.

21. The support for a microphone of claim 9, wherein the support arm is made of a glass filled polymer.

22. The support for a microphone of claim 9, further comprising a releasable fastener connecting the arm to the elongated connector, the fastener having a hand gripped head.

23. An enclosure and support for a microphone extending along a longitudinal axis during use, comprising:

a mounting connector having an inner rail and an outer portion outward of the rail relative to the longitudinal axis, the rail being parallel to the longitudinal axis;

at least one microphone support configured to slide along and releasably engage the inner rail to position the support along a length of the rail, the at least one microphone support configured to releasably engage the microphone during use to support the microphone along the longitudinal axis during use;

a first cage portion having a plurality of first elongated ribs with each first rib having a first distal end and a second opposing end, the first ribs configured to engage a plurality of rings including a first base retaining ring, the rings and ribs encircling the longitudinal axis and spaced apart from the at least one microphone support during use;

a second cage portion having a plurality of second elongated ribs with each second rib having a first distal end and a second opposing end, the second ribs configured to engage a plurality of rings including a second base retaining ring, the rings and ribs encircling the longitudinal axis and spaced apart from the at least one microphone support during use;

a bracket engaging the mounting connector and further engaging the first and second base rings of each cage portion during use.

24. The enclosure and support of claim 23, wherein each cage portion includes an outer ring engaging the first end of the ribs on an outer portion of a plurality of the ribs, each cage portion having and an intermediate ring located between the first and second ring of a cage portion and engaging an inner side of a plurality of the ribs.

25. The enclosure and support of claim 24, wherein each cage portion further includes a locking ring engaging the inner side of a plurality of ribs adjacent the location of the first ring.

26. The enclosure and support of claim 25, wherein the second cage portion has a first position engaging the bracket, a second portion spaced apart from the bracket but encircling the longitudinal axis, and a third position spaced apart from the bracket and rotated at an angle to the longitudinal axis to allow access to the at least one mounting support.

27. The enclosure and support of claim 25, wherein the at least one microphone support comprises a pair of curved support arms each extending from a base movably mounted to move along a length of the inner rail, each support arm curving continuously about the longitudinal axis a distance less than 360 degrees and ending in the support configured to releasably engage the microphone during use.

28. The enclosure and support of claim 27, wherein the curved arms each end in a pair of fingers including a lower finger located below the longitudinal axis and an upper finger located above the longitudinal axis, the support arms each extending over an arc of more than 180 degrees.

29. The support for a microphone of claim 28, wherein the fingers have an elastomeric material located to contact a microphone held by the fingers during use.

30. The enclosure of claim 28, wherein the microphone arms extend from the base in opposing directions.

31. The enclosure of claim 28, wherein the first end of each rib extends through an opening in a portion of the base ring to abut an inner side of the base retaining ring and the ribs snap lock to at least one of the rings.

32. The enclosure and support of claim 27, wherein the support arms have a T-shaped cross-section.

33. The enclosure and support of claim 27, wherein the support arm has a an I-shaped cross-section.

34. The support for a microphone of claim 27, wherein the support arms are made of a glass filled polymer.

35. The support for a microphone of claim 23, wherein the rail has a T-shaped cross-section.

36. The support for a microphone of claim 23, further comprising a releasable fastener connecting the arm to the rail, the fastener having a hand gripped head.

37. A enclosure and support for a microphone that extends along a longitudinal axis during use, comprising:

a mounting support;

a microphone support configured to releasably engage a microphone to hold the microphone along the longitudinal axis during use;

first and second cage portions each having a plurality of elongated ribs connected to a plurality of rings to form a structure encircling the longitudinal axis during use, each plurality of rings including a base retaining ring releasably connected to a connecting bracket that engages the mounting support to position the connecting bracket relative to the mounting support, the second cage portion releasably engaging the mounting support at different locations to define first and third positions, the first position having the base retaining ring of the second cage portion engaging the connecting bracket so the second cage portion encircles the longitudinal axis, the third position having the second cage portion rotated at an angle relative to the longitudinal axis with the base retaining ring of the second cage portion located to one side of the longitudinal axis.

38. The enclosure and support for a microphone of claim 37, wherein the second cage position has a second position encircling the longitudinal axis with the base retaining ring of the second cage portion spaced apart from the connecting bracket.

39. The enclosure and support for a microphone of claim 37, wherein the microphone support is connected to a base that releasably engages and is positionable along a length of the mounting support, the microphone support curving continuously around the longitudinal axis through an arc greater than 180 degrees and ending in two fingers located to engage the microphone on opposing sides of the longitudinal axis.

40. The support for a microphone of claim 39, wherein the fingers have an elastomeric material located to contact a microphone held by the fingers during use.

41. The enclosure and support for a microphone of claim 37, wherein a plurality of the ribs and rings of each cage portion are spring loaded against each other.

42. The enclosure and support for a microphone of claim 37, wherein a plurality of the ribs and rings of the first and second cage portions snap-fit together to form spring-loaded first and second cage portions.

* * * * *